US008087961B2

(12) United States Patent
Kameda et al.

(10) Patent No.: US 8,087,961 B2
(45) Date of Patent: Jan. 3, 2012

(54) METHOD OF PRODUCING A SPARK PLUG THAT HAS A HIGH DIMENSIONAL ACCURACY IN THE SPARK GAP

(75) Inventors: Hiroyuki Kameda, Aichi-gun (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 202 days.

(21) Appl. No.: 12/490,824

(22) Filed: Jun. 24, 2009

(65) Prior Publication Data

US 2009/0322198 A1 Dec. 31, 2009

(30) Foreign Application Priority Data

Jun. 25, 2008 (JP) ..... 2008-165254

(51) Int. Cl.
*H01T 21/00* (2006.01)
*H01T 21/02* (2006.01)

(52) U.S. Cl. ..... 445/7; 313/140; 313/141; 313/143; 313/118

(58) Field of Classification Search ..... 445/7; 313/118, 313/141
See application file for complete search history.

(56) References Cited

U.S. PATENT DOCUMENTS 5,556,315 A * 9/1996 Kagawa ..... 445/7
6,653,766 B2 * 11/2003 Hori ..... 313/141
6,798,124 B2 * 9/2004 Hiramatsu ..... 313/141
6,827,620 B1 * 12/2004 Mizutani ..... 445/7
2002/0067111 A1 * 6/2002 Shibata et al. ..... 313/141
2004/0092193 A1 * 5/2004 Musasa et al. ..... 445/7

FOREIGN PATENT DOCUMENTS

JP 07-022152 A 1/1995
JP 7022154 A 1/1995
JP 3273215 B2 4/2002
JP 2003-229231 A 8/2003

* cited by examiner

*Primary Examiner* — Sikha Roy
(74) *Attorney, Agent, or Firm* — Sughrue Mion, PLLC

(57) ABSTRACT

For producing a spark plug that has a high dimensional accuracy in the spark gap, a method is disclosed which comprises (a) preparing a semi-finished spark plug unit (100*b*) which comprises a center electrode (20) that has a leading end portion (22), a metal shell (50) that holds therein through an insulator (10) the center electrode (20) except the leading end portion (22) and a ground electrode (30) fixed to a leading end of the metal shell (50), (b) bending the ground electrode (30) so that a bent front portion (31) of the ground electrode (30) projects toward the leading end portion (22) of the center electrode (20), (c) putting an electrode tip (95) on a given part of the bent front portion (31) of the ground electrode (30) in such a manner that a front portion of the electrode tip (95) projects from the bent front portion (31) toward the leading end portion (22) of the center electrode (20) and (d) welding the electrode tip (95) to the given part of the bent front portion (31) of the ground electrode (30).

22 Claims, 14 Drawing Sheets

GROUND ELECTRODE FIXING STEP

CERAMIC INSULATOR FIXING STEP

GROUND ELECTRODE BENDING STEP

FIG.12A-a

GROUND ELECTRODE FIXING STEP
CERAMIC INSULATOR FIXING STEP
GROUND ELECTRODE BENDING STEP 100b
10
30
90
95
31
J1
PD
ED
OD
O
52
T1
TIP-JIG SETTING STEP

LASER BEAM
LASER WELDING STEP

METHOD OF PRODUCING A SPARK PLUG THAT HAS A HIGH DIMENSIONAL ACCURACY IN THE SPARK GAP

BACKGROUND OF THE INVENTION

1. Field of the Invention

The present invention relates to a method of producing a spark plug and a spark plug produced by the same, and more particularly to the method of producing a spark plug that has a high dimensional accuracy in the spark gap.

2. Description of the Related Art

Some of internal combustion engines are of a type that uses spark plugs for igniting air/fuel mixture compressed in combustion chambers of the engine with the aid of electric power.

As is shown in Japanese Laid-open Patent Application (tokkai) 2003-229231 and Japanese Patent 3273215, some of the spark plugs widely used are of a type that includes a center electrode that carries a high-voltage current from an ignition coil and a ground electrode that is located beside the center electrode and bent inward to produce a spark gap between the bent top of the ground electrode and a top of the center electrode. That is, upon application of the high-voltage current to the center electrode, a spark jumps from the center electrode to the ground electrode, which ignites the compressed air/fuel mixture.

For improving the spark, some of known ground electrodes are equipped with a noble metal tip. For producing such spark plugs, one method is known. That is, in the known method, a separate ground electrode is prepared, then a noble metal tip is welded to a leading part of the ground electrode, then the ground electrode thus equipped with the noble metal tip is subjected to a bending process for providing a bent front portion, and then the ground electrode thus bent is secured to a metal shell of the spark plug.

SUMMARY OF THE INVENTION

As is known, for improving the spark, it is essentially important to provide a spark gap between the center and ground electrodes with an exact distance or high dimensional accuracy.

For producing spark plugs that satisfy such essential condition, various methods have been proposed and put into practical use, one of which is mentioned hereinabove. However, hitherto, due to various reasons, satisfied method has not been proposed.

Accordingly, it is an object of the present invention to provide a method of producing a spark plug that has a high dimensional accuracy in the spark gap.

It is another object of the present invention to provide a spark plug that has a high dimensional accuracy in the spark gap.

In accordance with a first aspect of the present invention, there is provided a method of producing a spark plug, which comprises in steps (a) preparing a semi-finished spark plug unit, the unit comprising a center electrode that has a leading end portion, a cylindrical insulator that has an axial bore to install therein the center electrode except the leading end portion, a cylindrical metal shell that holds therein the cylindrical insulator and a ground electrode that has one end fixed to a leading end of the cylindrical metal shell; (b) bending the ground electrode so that a bent front portion of the ground electrode projects toward the leading end portion of the center electrode; (c) putting an electrode tip on a given part of the bent front portion of the ground electrode in such a manner that a front portion of the electrode tip projects from the bent front portion toward the leading end portion of the center electrode; and (d) welding the electrode tip to the given part of the bent front portion of the ground electrode.

In accordance with a second aspect of the present invention, there is provided a spark plug that is produced by the method of the present invention.

In accordance with a third aspect of the present invention, there is provided a spark plug which comprises a center electrode that has a leading end portion; a cylindrical insulator that has an axial bore to install therein the center electrode except the leading end portion; a cylindrical metal shell that holds therein the cylindrical insulator; a ground electrode that has one end fixed to a leading end of the cylindrical metal shell, the ground electrode having a bent front portion directed toward the leading end portion of the center electrode; and an electrode tip welded to the bent front portion of the ground electrode, a front portion of the second electrode tip projecting from the bent front portion toward the leading end portion of the center electrode thereby to define a spark gap between the electrode tip and the leading end portion of the center electrode.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, various embodiments of the method of the present invention and modifications of the embodiments of the invention will be described in detail with reference to the accompanying drawings.

For ease of understanding, various directional terms, such as, right, left, upper, lower, rightward and the like are used in the following description. However, these terms are to be understood with respect to only a drawing or drawings on which a corresponding element or portion is shown.

First Embodiment

First, with the aid of FIGS. 1 to 3 of the accompanying drawings, a spark plug 100 that can be produced by the method of the present invention will be described in the following.

Figure 1:
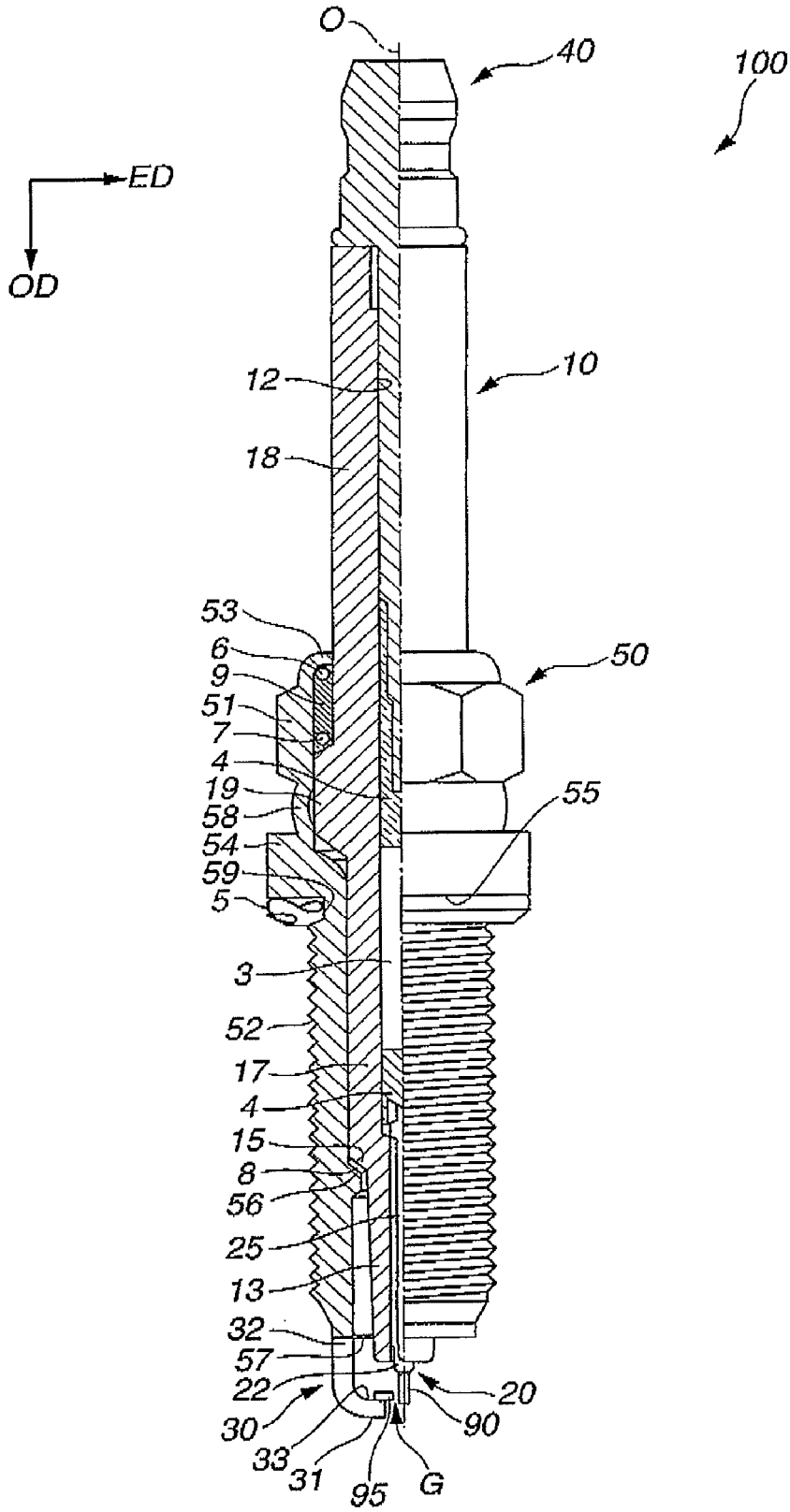
FIG. 1 is a partially sectional view of a spark plug that can be produced by a method of the present invention.
Figure 2:
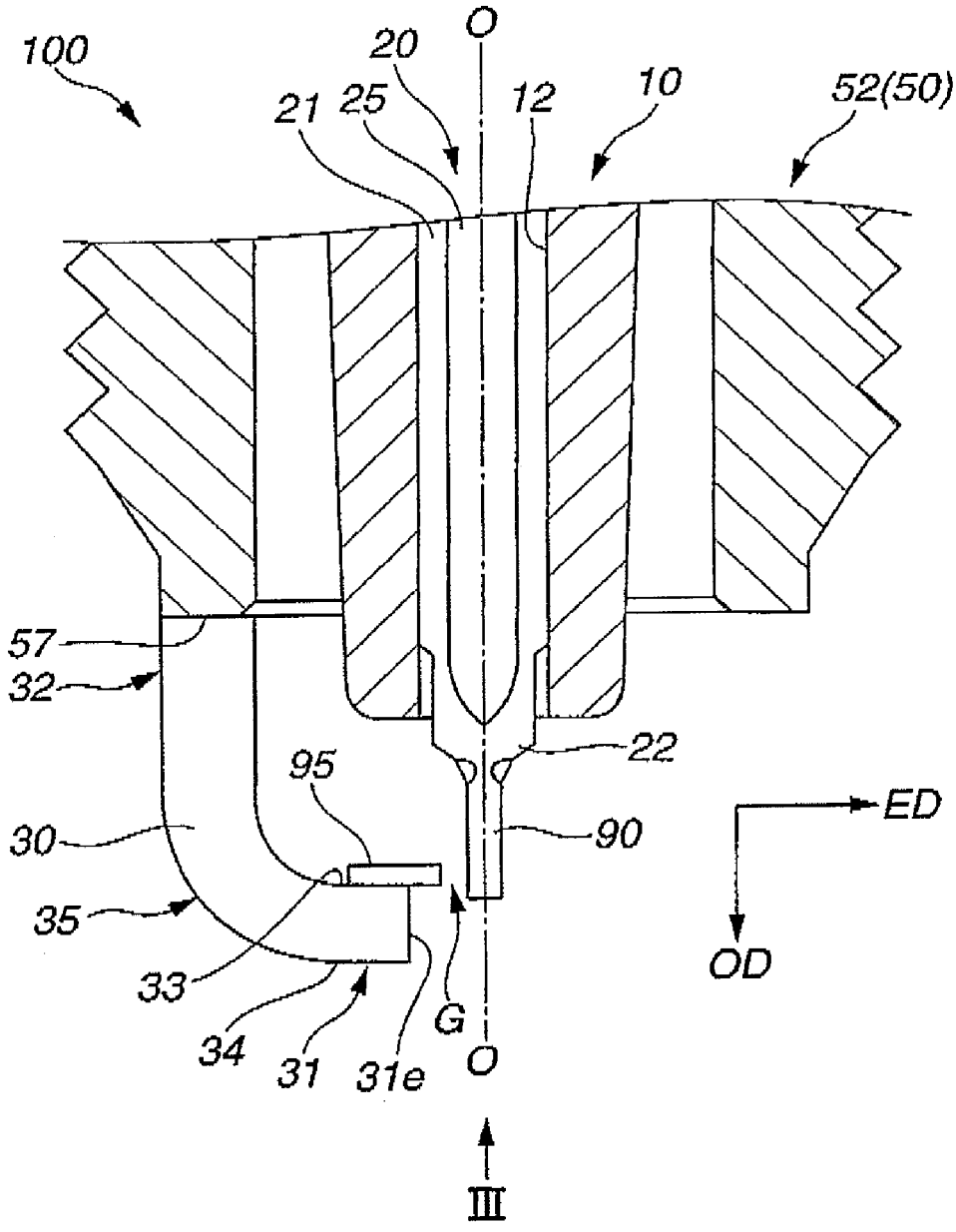
FIG. 2 is an enlarged sectional view of the spark plug at a portion near a tip of a center electrode.
Figure 3:
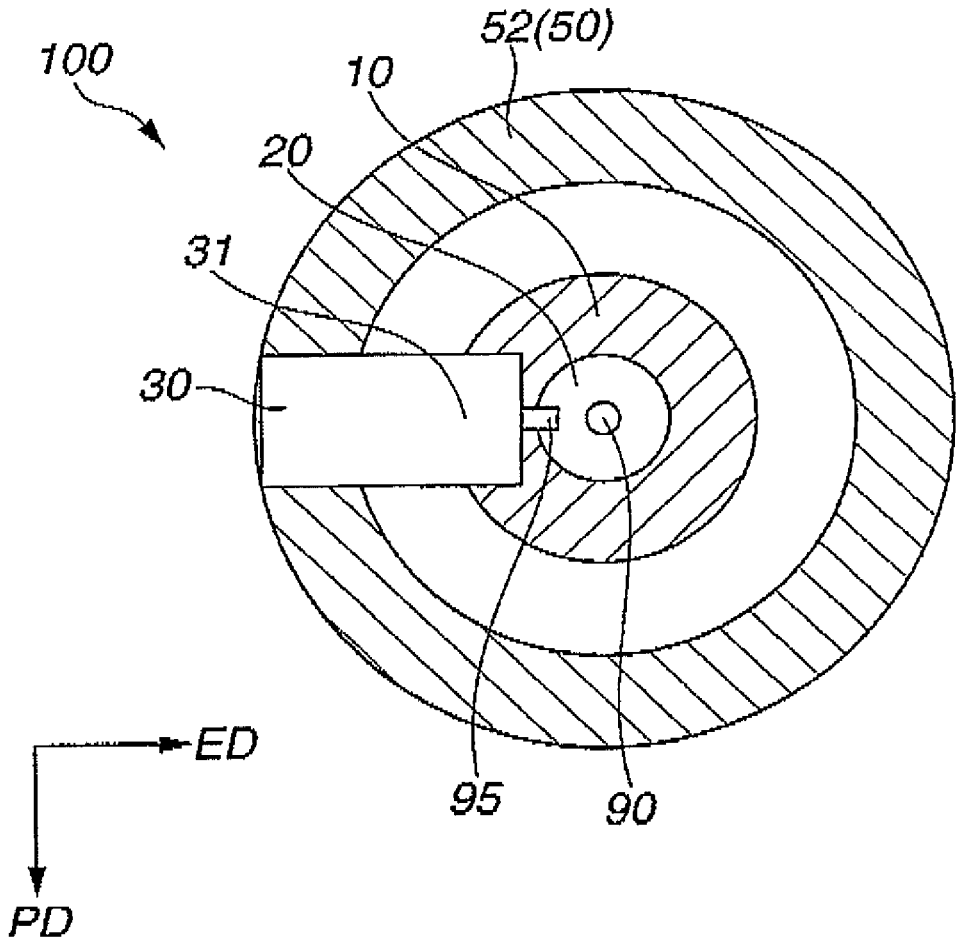
FIG. 3 is a view taken from a direction of the arrow "III" of FIG. 2.

FIG. 1 is a partially sectional view of the spark plug 100, FIG. 2 is an enlarged sectional view of the spark plug 100 at a portion near a tip 22 of a center electrode 20, and FIG. 3 is a view taken is from a direction of the arrow "III" of FIG. 2.

For ease of description, the direction along an axis "O" of the spark plug 100 will be called as a vertical (or upper-lower) direction in FIGS. 1 and 2, and thus, a lower side of the spark plug 100 will be called as a front end side, and an upper side of the spark plug 100 will be called as a rear end side.

In FIGS. 1 and 2, the direction of the axis "O" of the spark plug 100 is indicated by an arrow "OD" and a direction perpendicular to the axis "O" is indicated by an arrow "ED".

As is seen from FIG. 1, the spark plug 100 comprises an elongate cylindrical ceramic insulator 10, a center electrode 20 held by the front portion (viz., lower portion in FIG. 1) of the insulator 10, a terminal metal member 40 held by the rear end (viz., upper end in FIG. 1) of the insulator 10, a cylindrical metal shell 50 holding a lower half portion (viz., front half portion in FIG. 1) of the insulator 10, and a ground electrode 30 secured to a front end surface 57 of the metal shell 50. As shown, the elongate cylindrical ceramic insulator 10 is formed with an axially extending bore 12, and the metal shell 50 is in the shape of a cylindrical member and extends in the direction of the axis "O".

As is well shown in FIG. 2, the center electrode 20 is tightly received in a front end portion of the axial bore 12 of the ceramic insulator 10, and as is seen from FIG. 1, a diametrically reduced elongate front portion (no numeral) of the terminal metal member 40 is tightly received in a rear half portion of the axial bore 12 of the ceramic insulator 10.

As is well shown by FIG. 2, to the front end surface 57 of the metal shell 50, there is secured one (or rear) end of the ground electrode 30.

As is well shown, the ground electrode 30 extends straightly in the direction of the arrow "OD" away from the front end surface 57 and is bent inward at its front portion toward the axis "O" to constitute a bent front portion 31 of the ground electrode 30.

In the following, the elongate cylindrical ceramic insulator 10 will be described in detail with reference to the drawings, especially FIG. 1.

As is known, the ceramic insulator 10 is produced by firing (or baking) a green compact of alumina. As shown in FIG. 1, the ceramic insulator 10 is formed at an axially middle part thereof with an annular raised portion 19. From the annular raised portion 19, there extend both a rear side cylindrical portion 18 and a front side cylindrical portion 17 of which diameter is somewhat smaller than that of the rear side cylindrical portion 18, as shown. The front side cylindrical portion 17 has a diametrically reduced front end portion 13. As shown, the front end portion 13 has a tapered configuration. When the spark plug 100 is properly mounted to a cylinder head (not shown) of an internal combustion engine, the tapered front end portion 13 is exposed to a combustion chamber. As shown, between the tapered front end portion 13 and the front side cylindrical portion 17, there is defined a stepped portion 15.

In the following, the center electrode 20 will be described in detail with reference to FIGS. 1 and 2.

The center electrode 20 is a pin-like member that comprises a cylindrical base 21 that is made of nickel or nickel alloys, such as Inconel 600, 601 (trade name) or the like, and a core 25 that is embedded in the cylindrical base 21 and made of copper or copper alloys of which thermal conductivity is superior to that of the cylindrical base 21.

As is well shown in FIG. 2, the center electrode 20 is tightly received in the front end portion of the axial bore 12 of the ceramic insulator 10 in such a manner that a leading end portion 22 thereof projects outside from the ceramic insulator 10. The leading end portion 22 has a tapered configuration.

To a top of the leading end portion 22, there is secured a cylindrical electrode tip (or first electrode tip) 90 of rare metal for improving durability against the spark.

As is seen from FIG. 2, the first electrode tip 90 extends axially in the direction of the arrow "OD" to a position near a top surface 31*e* of the bent front portion 31 of the ground electrode 30. Of course, there is defined a given clearance (or spark gap) between the top surface 31*e* of the ground electrode 30 and the first electrode-tip 90. It is to be noted that if the leading end portion 22 of the center electrode 20 has a sufficient durability against the spark, the first electrode tip 90 may be removed.

As is best seen from FIG. 2, the leading end portion 22 of the center electrode 20 is formed with a diametrical reduced part 20*a* thereby to leave a cylindrical clearance (no numeral) between the leading end portion 22 of the center electrode 20 and that of the ceramic insulator 10. By applying the cylindrical clearance with a corona discharge, any carbonaceous materials that would be collected on the leading end portion of the ceramic insulator 10 under incomplete combustion of the engine are burnt out to allow the ceramic insulator 10 to recover an insulating ability.

As is seen from FIG. 1, the center electrode 20 extends rearward (viz., upward in FIG. 1) in the axial bore 12 of the ceramic insulator 10 passing through a first seal member 4, a ceramic resistor 3 and a second seal member 4 and is electrically connected to the terminal metal member 40. Although not shown in the drawing, to the terminal metal member 40, there is connected a high tension cable through a plug cap in practical use thereof.

In the following, the metal shell 50 will be described in detail with reference to FIG. 1.

The metal shell 50 is a cylindrical metal member for fixing the spark plug 100 to the cylinder head of the engine. The metal shell 50 is made of a low carbon steel. As shown, the metal shell 50 is constructed to hold therein a front half portion (viz., lower half portion in FIG. 1) of the ceramic insulator 10. In other words, the metal shell 50 extends forwardly from a front end of the rear cylindrical portion 18 of the ceramic insulator 10 to the diametrically reduced front end portion 13 of the insulator 10.

The metal shell 50 comprises a polygonal raised portion 51 that is to be handled by a plug wrench (not shown) and an externally threaded portion 52 that is to be engaged or meshed with an internally threaded plug mounting bore formed in the cylinder head of an internal combustion engine.

Between the raised polygonal portion 51 and the externally threaded portion 52, there is formed an annular raised seal portion 54. Furthermore, into an annular recess 59 formed between the threaded portion 52 and the seal portion 54, there is received an annular gasket 5 that is produced by bending a metal plate. That is, when the spark plug 100 is properly fixed to the plug mounting bore of the cylinder head, the annular gasket 5 is pressed and deformed between a bearing surface 55 of the seal portion 54 and an annular edge of the plug mounting bore. With such deformation of the annular gasket 5, a clearance between the bearing surface 55 and the annular edge of the plug mounting bore is hermetically sealed and thus air-tightness of a corresponding combustion chamber of the engine is kept.

At a rear part of the raised polygonal portion 51 of the metal shell 50, there is formed a thinner portion 53 that is caulked, and between the annular raised seal portion 54 and the raised polygonal portion 51, there is formed a thinner buckling portion 58. Between an inner cylindrical surface of the polygonal portion 51 of the metal shell 50 and an outer surface of the front part of the rear side cylindrical portion 18 of the ceramic insulator 10, there is defined an annular space (no numeral) in which a powdered talc 9 is tightly packed with the help of two holding rings 6 and 7.

As is understood from FIG. 1, by caulking the thinner portion 53 of the metal shell 50, the ceramic insulator 10 is pressed forward against the metal shell 50 through the powdered talc 9 and the two holding rings 6 and 7. With this, the stepped portion 15 of the ceramic insulator 10 is tightly seated and pressed, through an annular plate packing 8, on a stepped portion 56 formed on an inner cylindrical surface of the externally threaded portion 52 of the metal shell 50. Thus, the metal shell 50 and the ceramic insulator 10 constitute an integrated unit. Due to provision of the annular plate packing 8, the air-tightness between the metal shell 50 and the ceramic insulator 10 is assured, and thus, undesired exhaust gas leakage therethrough is suppressed. Upon caulking the thinner portion 53, the thinner buckling portion 58 is subjected to an outward deformation. In order to obtain a satisfied air-tightness between the metal shell 50 and the ceramic insulator 10, the annular space for the powdered talc 9 and the two holding rings 5 and 7 has a certain axial length.

In the following, the ground electrode 30 will be described in detail with reference to FIGS. 1 to 3.

As is seen from FIG. 2, the ground electrode 30 is a J-shaped pin member and made of a corrosion resistant metal, Like the above-mentioned center electrode 20, the ground electrode 30 is made of nickel or nickel alloys, such as Inconel 600, 601 (trade name) or the like. As is understood from FIG. 3, the ground electrode 30 has a generally rectangular cross section.

The ground electrode 30 comprises a longer base portion 32 that is secured to the front end surface 57 of the metal shell 50 by means of a resistance welding, a bent front portion 31 that has an after-mentioned second electrode tip 95 welded thereto and a curved portion 35 that connects the longer base portion 32 and the bent front portion 31.

As shown in FIG. 2, the longer base portion 32 extends axially in the direction of the arrow "OD", the curved portion 35 extends from the longer base portion 32 while gently curving toward the first electrode tip 90, and the front portion 31 thus bent extends straightly from the curved portion 35 toward the first electrode tip 90 of the center electrode 20. Of course, the bent front portion 31 does not reach the first electrode tip 90. That is, between the bent front portion 31 and the first electrode tip 90 of the center electrode 20, there is kept a certain clearance.

It is to be noted that the arrow "ED" shown in FIGS. 1 to 3 indicates a direction in which the bent front portion 31 extends. In the illustrated first embodiment, the direction of the arrow "ED" is perpendicular to that of the arrow "OD". It is further to be noted that the arrow "PD" shown in FIG. 3 indicates a direction that is perpendicular to both the direction of the arrow "ED" and that of the arrow "OD".

As is seen from FIG. 2, to an inside surface 33 of the bent front portion 31, there is secured, by means of a resistance welding, a pin-like electrode tip 95 (or second electrode tip 95) that has a leading portion projected beyond a top surface 31*e* of the front portion 31 toward the first electrode tip 90.

As is seen from FIGS. 2 and 3, between the leading end of the second electrode tip 95 and the cylindrical side surface of the first electrode tip 90 of the center electrode 20, there is defined a certain spark gap "G". The second electrode tip 95 is made of a spark resistant noble metal, such as platinum (Pt), iridium (Ir), rhodium (Rh) or the like. The second electrode tip 95 has a generally rectangular cross section. Of course, in place of the rectangular cross section, the electrode tip 95 may have different cross sections, such as a circular cross section, a triangular cross section, etc. Furthermore, the second electrode tip 95 may have a cross section that changes in shape as a longitudinal position changes.

As is mentioned hereinabove, the first electrode tip 90 projects from the center electrode 20 in the direction of the arrow "OD", and the second electrode tip 95 projects from the ground electrode 30 toward the cylindrical surface of the first electrode tip 90. With such arrangement of the two electrode tips 90 and 95, it has been revealed that a satisfied spark discharge is produced in the spark gap "G". A flame kernel is produced in the spark gap "G", and thus undesired heat drop, that would occur when the flame kernel contacts the ground electrode 30 at an initial stage of progressing process of the flame kernel, is suppressed or at least minimized.

As is understood from FIG. 2, the inside surface 33 of the bent front portion 31 of the ground electrode 30 is flat and substantially perpendicular to the direction of the arrow "OD".

The spark plug 100 having the above-mentioned construction can be manufactured as a small-sized spark plug of which threaded portion 52 has a nominal diameter smaller than M12. In such small-sized spark plug, the practical distance between the center electrode 20 and the ground electrode 30 is small. Thus, for obtaining a satisfied length of the longer base portion 32 and providing the longer base portion 32 with the bent front portion 31 at a leading end thereof, the radius of curvature of the curved portion 35 is made smaller than that of a common spark plug of which nominal diameter of the threaded portion is M14.

In the following, the method of producing the spark plug 100 having the above-mentioned construction, which is a first embodiment of the present invention, will be described in detail with reference to the accompanying drawings.

As will become clarified from the following, the method of the present invention generally comprises a preparation process in which various elements or parts of the produced spark plug 100 are produced and prepared and an assembling process in which the various elements or parts thus prepared are assembled.

First, the preparation process will be described. Since this preparation process is similar to a commonly used preparation process, the explanation will be briefly made.

In this preparation process, a ceramic insulator 10, a center electrode 20 and a ground electrode 30 are produced in a known manner. As is mentioned hereinabove, the ceramic insulator 10 is produced by firing (or baking) a green compact of alumina. That is, before firing, the green compact is subjected to a cutting process to have a desired shape. Then, the green compact is subjected to the firing (or baking) for producing the ceramic insulator 10. The center electrode 20 and the ground electrode 30 are made of nickel alloys as is mentioned hereinabove. In the base 21 of the center electrode 20, there is received a core 25 that is made of copper or copper alloys of which thermal conductivity is superior to that of the base 21.

Then, the center electrode 20, the first and second seal members 4, the ceramic resistor 3 and the terminal metal member 40 are put, in order, into the axial bore 12 of the ceramic insulator 10 to produce an elongate unit. Then, the elongate unit is subjected to a so-called glass sealing process (or heating-compression process) to integrally unite the mutually contacting parts. The metal shell 50 is made of a low carbon steel. By employing a deformation process, a cutting process and a threading process, the metal shell 50 is produced. As is mentioned hereinabove, the metal shell 50 has both the raised polygonal portion 51 and the annular raised seal portion 54 formed thereon.

In the following, the assembling process will be described in detail with the aid of the accompanying drawings, especially FIGS. 4A, 4B, 4C, 5A, 5B and 5C.

Figure 4A:
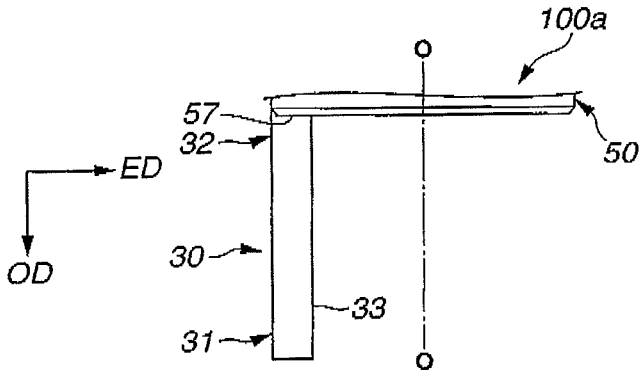
FIGS. 4A, 4B, 4C, 5A, 5B and 5C are schematic views depicting in order production steps of the spark plug by the method of a first embodiment of the present invention.
Figure 4B:
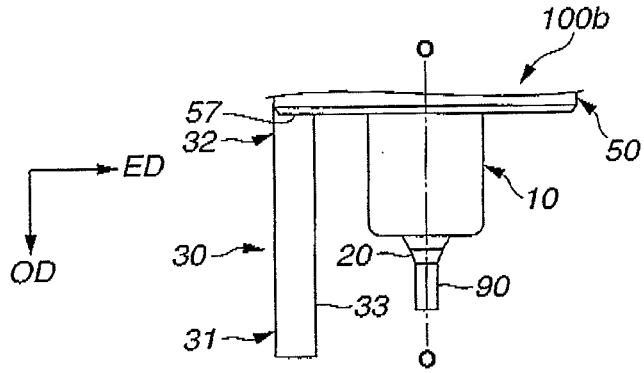
Figure 4C:
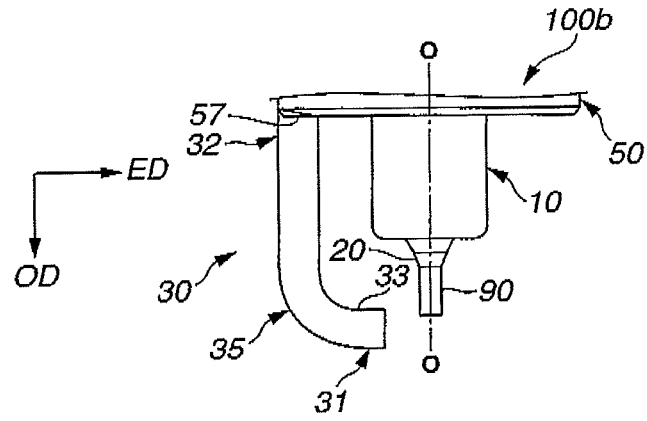
Figure 5A:
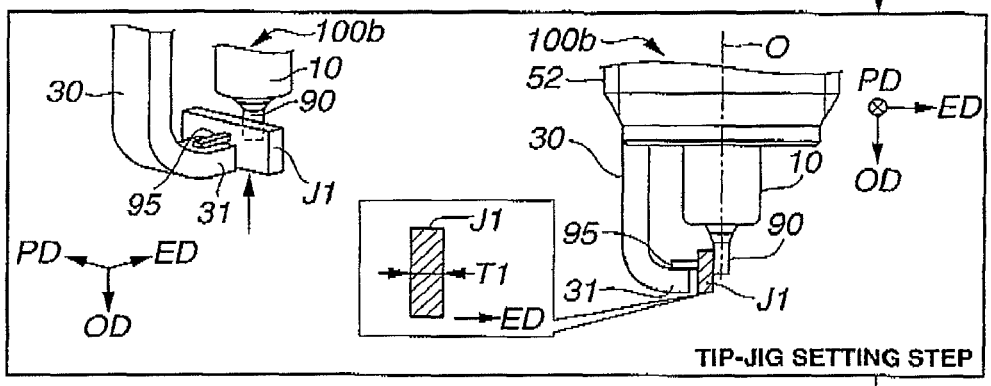
Figure 5B:
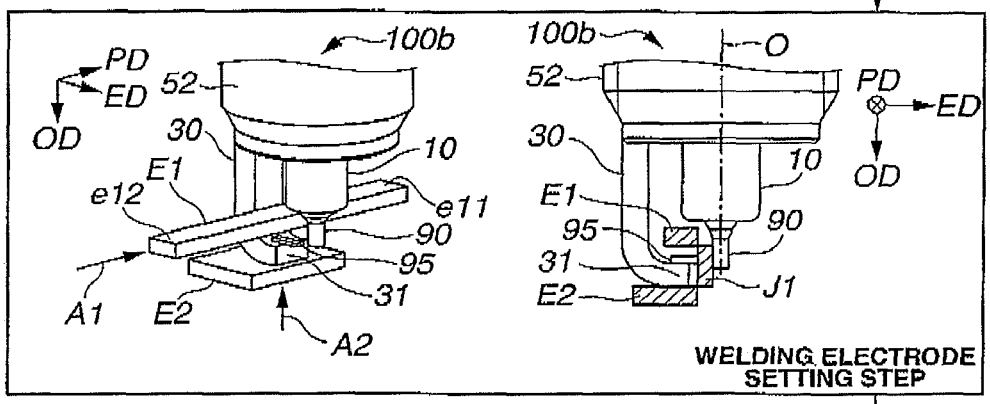
Figure 5C:
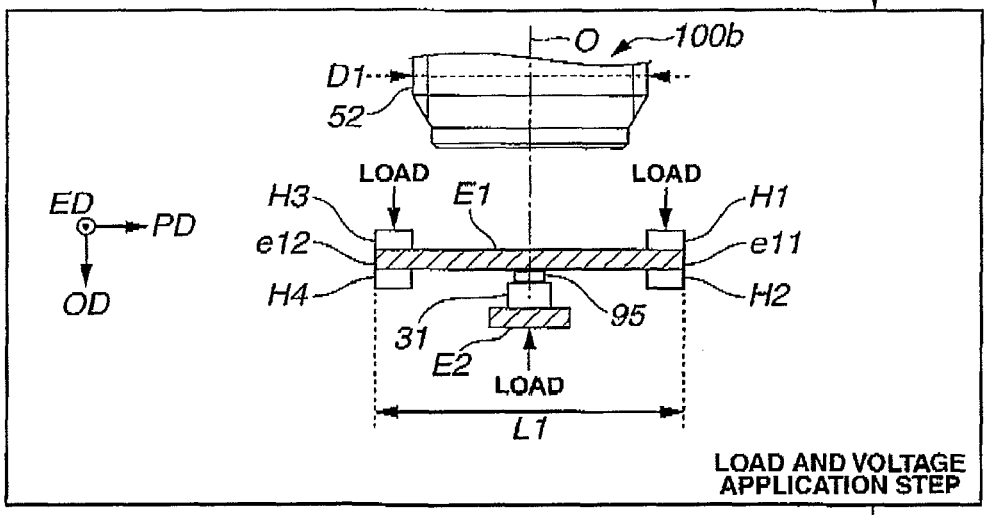

FIGS. 4A, 4B, 4C, 5A, 5B and 5C show the assembling process for assembling the spark plug 100. FIGS. 4A, 4B and 4C show a process from a ground electrode fixing step to a ground electrode bending step, and FIGS. 5A, 5B and 5C show a process from a tip-jig setting step, which is subsequent to the ground electrode bending step of FIG. 4C, to a load and voltage application step.

As is seen from FIG. 4A, in the ground electrode fixing step, to the front end surface 57 of a naked metal shell 50, there is welded the longer base portion 32 of the ground electrode 30 by means of a resistance welding technique. As is seen from this drawing, in this fixing step, the ground electrode 30 is straight in shape. That is, the ground electrode 30 secured to the front end surface 57 of the metal shell 50 extends in the direction of the arrow "OD", that is, extends in parallel with the axis (O) of the metal shell 50. Thereafter, although not shown, a plating process is carried out. In the plating process, the ground electrode 30 is kept masked and thus only the metal shell 50 is plated. The ground electrode 30 is not plated for the purpose of obtaining assured welding of the electrode tip 95 to the ground electrode 30 as will become apparent hereinafter. By the ground electrode fixing step, a so-called metal shell-ground electrode unit 100*a* is produced.

Then, as is seen from FIG. 4B, a ceramic insulator fixing step is carried out. In this step, into the metal shell-ground electrode unit 100*a* thus produced, there is inserted the ceramic insulator 10 that has been prepared in the above-mentioned preparation process. Then, the thinner portion 53 (see FIG. 1) of the metal shell 50 is caulked. With this, as is understood from FIG. 1, the ceramic insulator 10 pressed forward against the metal shell 50 through the powdered talc 9 and the two holding rings 6 and 7. Thus, the stepped portion 15 of the ceramic insulator 10 is tightly seated or pressed, through the annular plate packing 8, onto the stepped portion 56 of the annular cylindrical surface of the externally threaded portion 52 of the metal shell 50. Thus, the ceramic insulator 10 is integrally and tightly held by the metal shell 50 having the leading end portion of the center electrode 20 projected from the leading end portion of the metal shell 50. With this, a so-called metal shell-ground electrode-ceramic insulator unit 100*b* is produced.

For ease of the following description, the unit 100*b* will be called just as "a semi-finished spark plug unit 100*b*" in the following.

Then, as is seen from FIG. 4C, in the ground electrode bending step, the ground electrode 30 that has been straight in shape is subjected to a bending process to have the bent front portion 31. For bending the ground electrode 30, various methods are employable. For example, by using a plurality of bending dies of which cavities gradually change in bending angle, the bending of the ground electrode 30 may be carried out stepwise. Of course, such bending may be made at one pressing. By the bending step, the ground electrode 30 is bent to have a desired J-shape including, as is seen from FIG. 2, the longer base portion 32, the bent front portion 31 and the curved portion 35.

Upon completion of the ground electrode bending step of FIG. 4C, the process shown in FIGS. 5A, 5B and 5C is carried out.

In FIG. 5A, there are shown, but partially, perspective and side views of the semi-finished spark plug unit 100*b* that is produced by carrying out the above-mentioned process of FIGS. 4A to 4C. The side view is taken from the direction of the arrow "PD".

In the tip-jig setting step of FIG. 5A, orientation of the ground electrode 30 (or metal shell 50) is so made that the axial direction of the arrow "OD" is vertical. Then, by using a holder (not shown), the semi-finished spark plug unit 100*b* is stably held. In other words, both the metal shell 50 and the ground electrode 30 are held stably. This stable holding is kept until an after-mentioned welding for the second electrode tip 95 is finished.

Then, the second electrode tip 95 is put on the bent front portion 31 of the ground electrode 30, and a rectangular spacer jig J1 is placed between the second electrode tip 95 and the first electrode tip 90. Then, the second electrode tip 95 is pushed toward the spacer jig J1 to move the same to a stable position where the spacer jig J1 is intimately sandwiched between the two electrode tips 90 and 95. With this, the second electrode tip 95 is placed on a desired position of the bent front portion 31 where the second electrode tip 95 is to be welded. The spacer jig J1 is made of an insulating material, such as ceramic or the like. It is to be noted that the thickness "T1" of the spacer jig J1 (viz., the dimension in the direction of the arrow "ED") is determined to a value corresponding to the distance of the desired spark gap "G".

Then, as is seen from FIG. 5B, a welding electrode setting step is carried out. In FIG. 5B, there are shown perspective and side views of the semi-finished spark plug unit 100*b*. The side view is taken from the direction of the arrow "PD". It is to be noted that in the perspective view, the spacer jig J1 is not shown for clarifying the detail of the arrangement of the other parts.

As is understood from FIG. 5B, in the welding electrode setting step, first and second welding electrodes E1 and E2 are placed at upper and lower positions with respect to the bent front portion 31 of the ground electrode 30. In the illustrated first embodiment, the first welding electrode E1 is placed above the bent front portion 31. More specifically, the first welding electrode E1 is placed between the front end portion (viz., the externally threaded portion 52) of the metal shell 50 and the bent front portion 31 of the ground electrode 30 while pressing the second electrode tip 95 against the bent front portion 31, as shown. The second welding electrode E2 is placed below the bent is front portion 31.

As shown in FIG. 5B, the first welding electrode E1 is in the shape of a square bar. First, as is indicated by the arrow "A1", the first welding electrode E1 is oriented to extend in the direction of the arrow "PD", and then the first welding electrode E1 is moved in the direction of the arrow "PD" (or A1) over the bent front portion 31. That is, the first welding electrode E1 approaches the bent front portion 31 moving along the direction of the arrow "PD". Upon completion of the approach, the first welding electrode E1 is so positioned that a leading end e11 thereof is projected beyond one cylindrical side of the externally threaded portion 52 and a trailing end e12 thereof is projected beyond a diametrically opposite cylindrical side of the threaded portion 52.

The second welding electrode E2 is in the shape of a flat rectangular plate. The second welding electrode E2 is moved upward in the direction of the arrow "A2" to approach the lower part of the bent front portion 31. In the illustrated first embodiment, the second welding electrode E2 is used as a so-called ground electrode.

Then, as is shown in FIG. 5C, the load and voltage application step is carried out. The view of FIG. 5C is a side view taken from a direction opposite to the direction of the arrow "ED".

In the load and voltage application step, the second electrode tip 95 is practically welded to the given part of the bent front portion 31 of the ground electrode 30 by means of a resistance welding. During this welding, the leading end e11 of the first welding electrode E1 is kept held by holding members H1 and H2, and the trailing end e12 of the electrode E1 is kept held by holding members H3 and H4. During the welding, by a suitable biasing force applied to these holding members H1, H2, H3 and H4, the first welding electrode E1 is kept biased toward is the second welding electrode E2. That is, a given load is kept applied to the first welding electrode E1 in the direction of the arrow "OD". While, the second welding electrode E2 is kept biased toward the first welding electrode E1. That is, during the welding, a given load is kept applied to the second welding electrode E2 in a direction opposite to the direction of the arrow "OD". As a result, a middle portion of the first welding electrode E1 is forced to contact the second electrode tip 95 and at the same time a center portion of the second welding electrode E2 is forced to contact the lower surface of the bent front portion 31 of the ground electrode 30, as shown. That is, the second electrode tip 95 and the bent front portion 31 are sandwiched between the first and second welding electrodes E1 and E2 while being biased toward each other. That is, during the welding, the electrode tip 95 is kept pressed against the bent front portion 31, and at the same time, the bent front portion 31 is kept pressed against the electrode tip 95.

The surface of the first welding electrode E1 to which the second electrode tip 95 contacts is in parallel with the inside surface 33 of the bent front portion 31. Like this, the surface of the second welding electrode E2 to which the bent front portion 31 contacts is in parallel with an outer surface 34 (see FIG. 2) of the bent front portion 31. In the illustrated first embodiment, these two surfaces are perpendicular to the axial direction "OD".

Then, for the practical welding, a certain high voltage is applied between the first and second welding electrodes E1 and E2 while biasing these electrodes E1 and E2 toward each other. By this voltage application, a certain current flows through the second electrode tip 95 and the bent front portion 31 thereby welding the second electrode tip 95 to the bent front portion 31. More specifically, a portion of the electrode tip 95 to which the inner surface 33 of the bent front portion 31 contacts and a portion of the bent front portion 31 to which the second electrode tip 95 contacts are welded together.

Figure 6A:
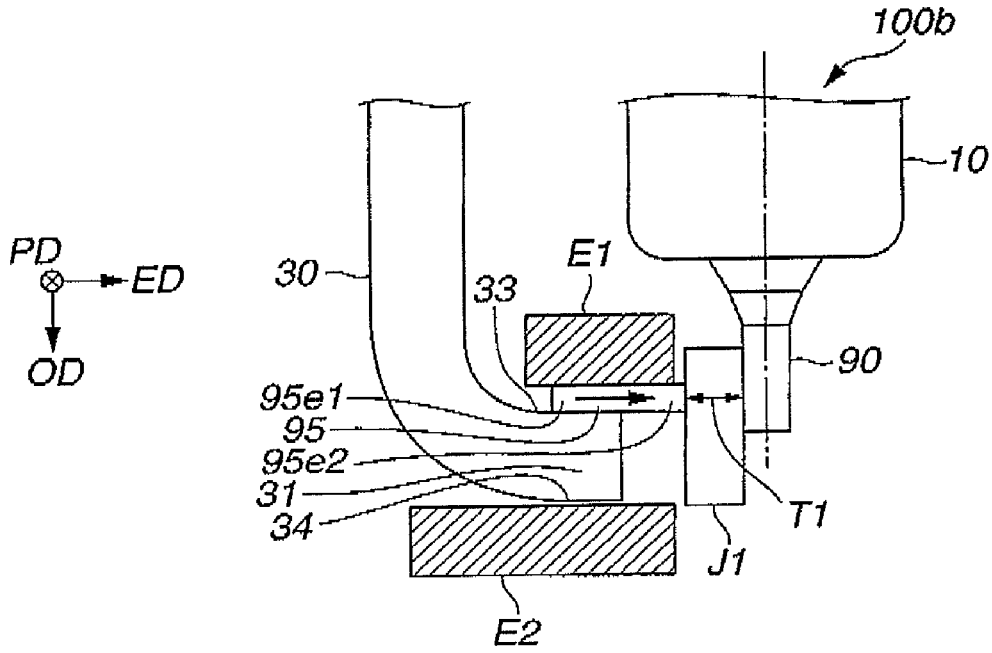
FIGS. 6A and 6B are schematic views depicting a manner for welding an electrode tip to a leading end of the ground electrode in the first embodiment.
Figure 6B:
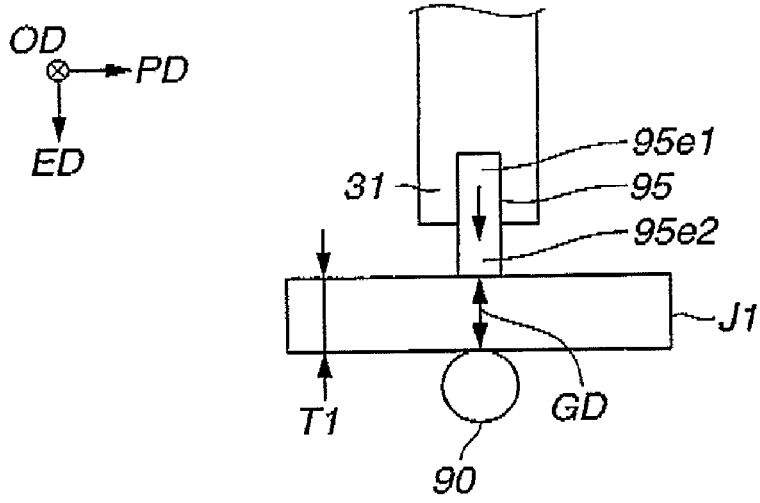

FIGS. 6A and 6B are schematic drawings depicting the manner for welding the electrode tip 95 to the bent front portion 31. FIG. 6A is a view taken in the direction of the arrow "PD", and FIG. 6B is a view taken in the axial direction of the arrow "OD". As is seen from FIG. 6A, a left portion 95*e*1 of the second electrode tip 95 (viz., a portion of the second electrode tip 95 that extends in a direction opposite to the direction of the arrow "ED") is put on the bent front portion 31. That is, the left portion 95*e*1 faces the inner surface 33 of the bent front portion 31. While, a right portion 95*e*2 of the second electrode tip 95 (viz., a portion of the second electrode tip 95 that extends in the direction of the arrow "ED") is not put on the bent front portion 31. That is, the right portion 95*e*2 projects beyond the bent front portion 31 in the direction of the arrow "ED".

As is shown in FIG. 6A, the first welding electrode E1 contacts entirely with the left portion 95*e*1 of the second electrode tip 95 and partially contacts with the right portion 95*e*2 of the second electrode tip 95. With this arrangement, both the left portion 95*e*1 and the right portion 95*e*2 of the second electrode tip 95 are biased or pressed toward the bent front portion 31 of the ground electrode 30.

Under welding, a frictional resistance between the electrode tip 95 and the bent front portion 31 becomes low because the mutually contacting portions of these elements 95 and 31 go into a liquid state, which tends to induce a slippage of the second electrode tip 95 on the inner surface 33 of the bent front portion 31. Furthermore, as is mentioned hereinabove, the electrode tip 95 is pressed against the inner surface 33 of the bent front portion 31, and only the left portion 95*e*1 of the tip 95 is supported by the bent front portion 31. Under such condition, upon welding, the electrode tip 95 tends to slip rightward in FIG. 6A because of generation of a certain force applied in a direction not to support the second electrode tip 95 by the bent front portion 31. In the illustrated first embodiment, the left portion 95*e*1 of the second electrode tip 95 is supported by the bent front portion 31, while the right portion 95*e*2 is not sufficiently supported by the bent front portion 31. Accordingly, upon welding, it tends to occur that the second electrode tip 95 slips rightward in FIG. 6A in the direction of the arrow "ED", that is, in the direction from the left portion 95*e*1 to the right portion 95*e*2.

However, in the invention, for suppressing such undesired slippage of the electrode tip 95, the spacer jig J1 is used as is shown in FIG. 6A. That is, if such slippage of the second electrode tip 95 occurs, the spacer jig J1 stops the slippage. Upon this, the second electrode tip 95 is stopped by the spacer jig J1. As is mentioned hereinabove, the thickness "T1" of the spacer jig J1 is substantially equal to the distance of the desired spark gap "G".

The spacer jig J1 is kept pressed against the first electrode tip 90. Accordingly, by advantageously using the phenomenon of the slippage of second electrode tip 95 under welding, the distance between the two electrode tips 95 and 90 for the desired spark gap "G" can be easily and accurately obtained.

Upon completion of welding for the second electrode tip 95, the first and second welding electrodes E1 and E2 and the spacer jig J1 are removed. With this, production of the spark plug 100 is completed. The order of removing the parts E1, E2 and J1 is free that is, at will. That is, if desired, the removing order may be reversed to the order of arranging the parts.

As is mentioned hereinabove, in the first embodiment, the welding of the second electrode tip 95 to the ground electrode 30 is carried out after the ground electrode 30 is subjected to the bending process. Accordingly, position adjustment of the second electrode tip 95 relative to the first electrode tip 90 of the center electrode 20 is easily made.

The bending of the ground electrode 30 for providing the bent front portion 31 is carried out after the ground electrode 30 is fixed to the metal shell 50 in which the ceramic insulator 10 holding the center electrode 20 is installed. Thus, the bending of the ground electrode 30 is easily made because the metal shell 50 can serve as a so-called stable weight.

The spacer jig J1 is intimately sandwiched between the two electrode tips 95 and 90 during the time when the second electrode tip 95 is being welded to the ground electrode 30. Thus, a dimensionally accurate spark gap "G" is easily produced between the two electrode tips 95 and 90. Particularly in the first embodiment, under welding of the second electrode tip 95 to the bent front portion 31 by applying a certain voltage between the two welding electrodes E1 and E2, the second electrode tip 95 and the bent front portion 31 of the ground electrode 30 are kept biased toward each other having the spacer jig J1 intimately kept between the two electrode tips 95 and 90. With this welding technique, the second electrode tip 95 is welded to the desired part of the ground electrode 30 and thus a desired spark gap "G" can be provided between the two electrode tips 95 and 90.

During welding process of the second electrode tip 95 to the ground electrode 30, the first welding electrode E1 is kept in contact with both the left portion 95*e*1 of the electrode tip 95 that is seated on the bent front portion 31 of the ground electrode 30 and the right portion 95*e*2 of the electrode tip 95 that is not seated on the bent front portion 31 of the ground electrode 30. Thus, upon application of a certain load, the second electrode tip 95 is biased to move or slip toward the first electrode tip 90. Then, upon welding, due to a liquid state appearing between the mutually contacting areas of these two elements 95 and 31, the second electrode tip 95 is caused to slide toward the first electrode tip 90 with ease. This movement promotes the adjustment for the distance of the desired spark gap "G" between the two electrode tips 95 and 90. When the voltage application stops, the welding stops and thus the second electrode tip 95 is fixed to the desired position of the bent front portion 31 of the ground electrode 30, and thus, the desired spark gap "G" is accurately provided between the two electrode tips 95 and 90. As is mentioned hereinabove, adjustment for the desired spark gap "G" is carried out during the welding and the desired spark gap "G" is fixed when the welding is finished.

In the first embodiment, the load application to the second welding electrode E2 is easily made from the outside of the curved portion 35 of the ground electrode 30. Furthermore, since the first welding electrode E1 that is in contact with the electrode tip 95 is applied with the certain load, the electrode tip 95 is suitably pressed against the bent front portion 31 of the ground electrode 30. Furthermore, since, as is understood from FIG. 5C, both ends of the first welding electrode E1 are held by the holding members H1, H2, H3 and H4, unstable contact between the first welding electrode E1 and the second electrode tip 95 is suppressed.

As is seen from FIG. 5C, for the stable holding of the first welding electrode E1, the axial length "L1" of the first welding electrode E1 should be larger than the nominal diameter "D1" of the threaded portion 52 of the metal shell 50.

Furthermore, in the first embodiment (see FIG. 5B), for positioning the first welding electrode E1 to the bent front portion 31 of the ground electrode 30, the first welding electrode E1 is moved in the direction of the arrow "PD" that is perpendicular to both the direction of the arrow "OD" and that of the arrow "ED". Thus, undesired contact of the first welding electrode E1 with each of the metal shell 50, the ground electrode 30, the ceramic insulator 10 and the center electrode 20 (viz., the first electrode tip 90) during the axial movement of the same is assuredly suppressed. Furthermore, as is seen from FIGS. 5A and 5B, prior to the welding electrode setting step (FIG. 5B), the metal shell 50 is held by a holder (not shown) and thus the ground electrode 30 is stably held. This promotes the accurate positioning of the second electrode tip 95 relative to the bent front portion 31 of the ground electrode 30. Furthermore, as is seen from FIG. 5C, under welding, the first welding electrode E1 is kept applied with a certain load for pressing the electrode tip 95 against the inner surface 33 of the bent front portion 31, and thus, the welding of the second electrode tip 95 to the inside surface 33 is accurately and assuredly made.

Second Embodiment

In the following, a second embodiment of the method of the invention will be described with the aid of FIGS. 7A and 7B.

Since the second embodiment is similar to the above-mentioned first embodiment, only steps that are different from those of the first embodiment will be described in the following.

As is seen from FIGS. 7A and 7B, in the welding electrode setting step and the load and voltage application step of this second embodiment, there is employed a first welding electrode E1*a* (which will be called as a shorter first welding electrode hereinafter) that is shorter than the first welding electrode E1 of the above-mentioned first embodiment. Other steps of the second embodiment are substantially the same as those of the first embodiment.

Figure 7A:
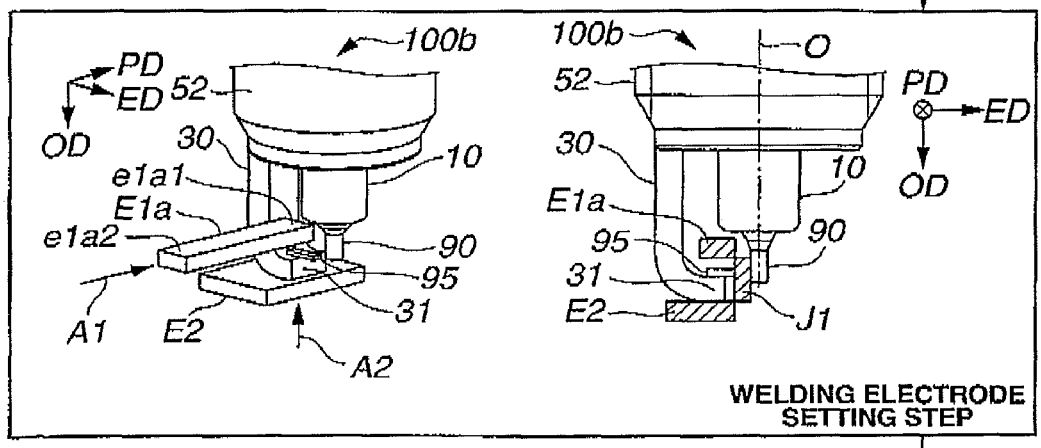
FIGS. 7A and 7B are schematic views depicting another manner for welding the electrode tip to the leading end of the ground electrode in a second embodiment of the present invention.

In FIG. 7A that depicts the welding electrode setting step, there are shown, but partially, perspective and side views of the semi-finished spark plug unit 100*b* that is produced by carrying out the process of FIGS. 4A to 4C. It is to be noted that in the perspective view, the spacer jig J1 is not shown for showing the detail of the arrangement of the other parts.

As is understood from FIG. 7A, in the welding electrode setting step of the second embodiment, the shorter first welding electrode E1*a* is oriented in the direction of the arrow "PD" and then moved in the direction of the arrow "PD" (or A1) to a given position over the bent front portion 31 of the ground electrode 30. As is understood from FIG. 7B, upon reaching the given position, the shorter first welding electrode E1*a* takes such a position that a leading end e1*a*1 thereof is positioned just above the electrode tip 95 put on the bent front portion 31 of the ground electrode 30 and a trailing end e1*a*2 thereof projects leftward in FIG. 7B beyond the cylindrical side of the threaded portion 52. The second welding electrode E2 moves upward in the direction of the arrow "A2" to approach the lower part of the bent front portion 31. Also, in this second embodiment, the second welding electrode E2 is used as a ground electrode.

Figure 7B:
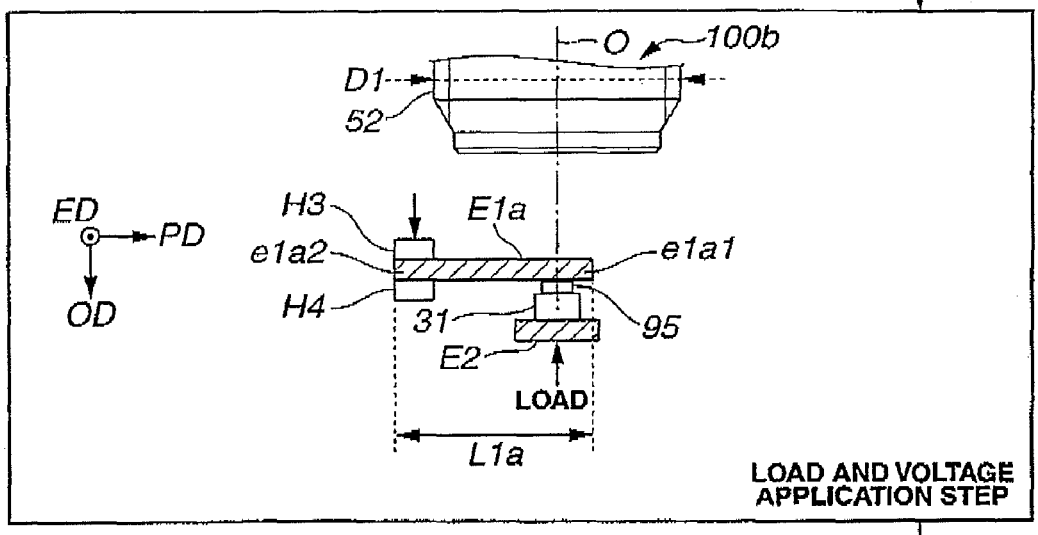

Then, as is shown in FIG. 7B, the load and voltage application step is carried out. The view of FIG. 7B is a side view taken from the direction of the arrow "ED".

In the load and voltage application step, the second electrode tip 95 is welded to a given part of the bent front portion 31 of the ground electrode 30 by means of a resistance welding. During this welding, the trailing end e1*a*2 of the shorter first welding electrode E1*a* is held by holding members H3 and H4, and by these holding members H3 and H4, the shorter first welding electrode E1*a* is kept biased toward the second welding electrode E2. That is, a given load is kept applied to the shorter first welding electrode E1*a* in the direction of the arrow "OD". While, the second welding electrode E2 is kept biased toward the shorter first welding electrode E1*a*. That is, during the welding, a given load is kept applied to the second welding electrode E2 in a direction opposite to the direction of the arrow "OD" As a result, the leading end portion e1*a*1 of the shorter first welding electrode E1*a* is forced to contact the second electrode tip 95 and at the same time the center portion of the second welding electrode E2 is forced to contact the lower surface of the bent front portion 31 of the ground electrode 30, as shown. That is, the second electrode tip 95 and the bent front portion 31 are sandwiched between the shorter first welding electrode E1*a* and the second welding electrode E2.

Then, for the practical welding, a certain high voltage is applied between the shorter first welding electrode E1*a* and the second welding electrode E2 while biasing these two electrodes E1*a* and E2 toward each other. By this voltage application, a certain current flows through the second electrode tip 95 and the bent front portion 31 thereby welding the second electrode tip 95 to the bent front portion 31.

As is described hereinabove, in the second embodiment, during the welding, the leading end portion e1*a*1 of the shorter first welding electrode E1*a* is intimately put on the second electrode tip 95 and the trailing end portion e1*a*2 of the electrode E1*a* is stably held by the holding members H3 and H4. Accordingly, even when the semi-finished spark plug unit 100*b* fails to provide the inside of the ground electrode 30 with a sufficient space, an assured contact between the shorter first welding electrode E1*a* and the second electrode tip 95 is easily obtained.

As is seen from FIG. 7B, for the stable holding of the shorter first welding electrode E1*a*, the axial length "L1*a*" of the shorter first welding electrode E1*a* should be larger than a half of the nominal diameter "D1" of the threaded portion 52 of the metal shell 50 but smaller than the nominal diameter "D1".

Third Embodiment

In the following, a third embodiment of the method of the present invention will be described with the aid of FIGS. 8A, 8B and 8C.

In this third embodiment, a spacer jig J2 that is different from the above-mentioned spacer jig J1 is used.

As is understood from the drawings, the spacer jig J2 is rectangular in shape. The spacer jig J2 has, on a major surface thereof that contacts the top surface 31*e* of the bent front portion 31 of the ground electrode 30, a vertically extending first recess R1 and on an opposite major surface thereof that contacts the first electrode tip 90, a vertically extending second recess R2. As will be described in detail hereinbelow, the first recess R1 has a rectangular cross section and the second recess R2 has a semi-circular cross section.

Figure 8A:
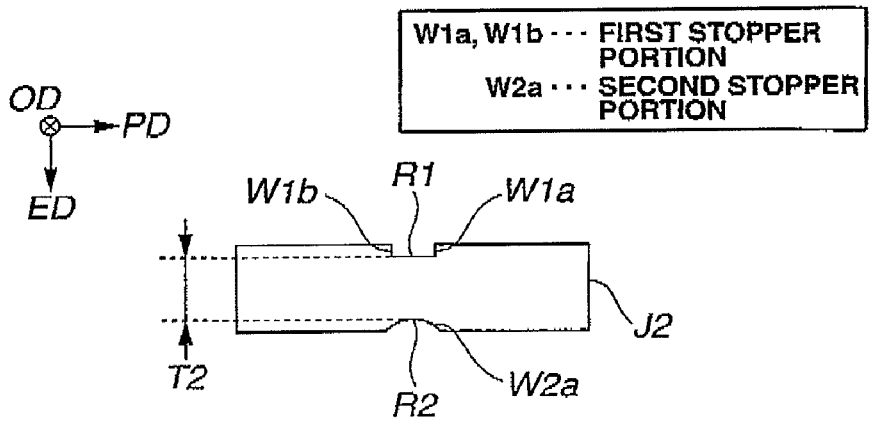
FIGS. 8A, 8B and 8C are schematic views depicting a manner for handling a spacer jig in a third embodiment of the present invention.
Figure 8B:
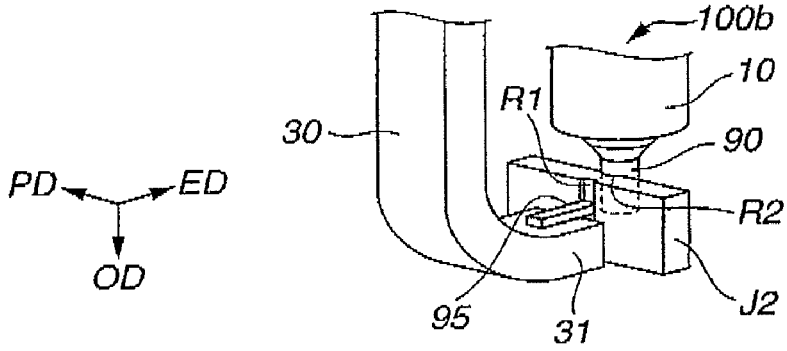
Figure 8C:
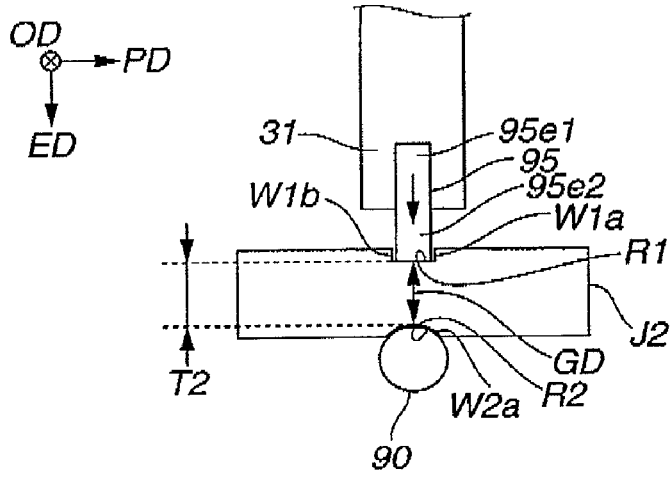

FIG. 8A is a view of the spacer jig J2 taken in the direction of the arrow "OD", FIG. 8B is a perspective view of the front portion of the semi-finished spark plug unit 100*b* with the spacer jig J2 properly set, and FIG. 8C is a view of the front portion of the semi-finished spark plug unit 100*b* taken in the direction of the arrow "OD".

As is seen from FIGS. 8B and 8C, the first recess R1 is shaped to snugly put therein the projected front portion of the second electrode tip 95 that is unstably supported on the bent front portion 31 of the ground electrode 30. As is understood from FIG. 8C, when the projected front portion of the second electrode tip 95 is properly put in the first recess R1, movement of the electrode tip 95 in the direction of the arrow "ED" and movement of the projected front portion of the electrode tip 95 in a direction parallel with the direction of the arrow "PD" are both suppressed or at least restricted. That is, due to contact with a bottom wall (no numeral) of the first recess R1, further downward movement in FIG. 8C of the second electrode tip 95 is suppressed, and due to contact with side walls W1*a* and W1*b* of the first recess R1, lateral movement of the projected front portion of the second electrode tip 95 is restricted.

As is seen from FIGS. 8B and 8C, the second recess R2 is shaped to snugly put therein a cylindrical side portion of the first electrode tip 90 that is secured to the front portion of the center electrode 20. As is understood from FIG. 8C, when the cylindrical side portion of the first electrode tip 90 is properly put in the second recess R2, movement of the spacer jig J2 in the direction of the arrow "ED" and that in a direction parallel with the direction of the arrow "PD" are both suppressed or at least restricted. That is, due to intimate contact between the cylindrical side portion of the first electrode tip 90 and a concave surface W2*a* of the second recess R2, such movement of the spacer jig J2 is suppressed.

When the spacer jig J2 is properly set between the two electrode tips 95 and 90 in such a manner as is shown in FIG. 8C, welding of the electrode tip 95 to the bent front portion 31 of the ground electrode 30 is carried out in the above-mentioned manner. For the welding, the method employed in the first embodiment or the method employed in the second embodiment may be used.

Due to provision of the first and second recesses R1 and R2, the position accuracy of the spacer jig J2 relative to the front portion of the semi-finished spark plug unit 100*b* increases, and thus, the spark plug 100 thus produced can exhibit excellent dimension accuracy in the spark gap "G". As is seen from FIG. 8C, the distance "T2" between the bottom of the first recess R1 and that of the second bottom R2 is previously set to the distance for the desired spark gap "G". With this, the desired spark gap "G" is easily possessed by the spark plug 100 thus produced. As is understood from FIG. 8B, upon finishing of the welding, the spacer jig J2 is moved downward, that is, in the direction of the arrow "OD" from the set position.

Fourth Embodiment

Figure 9:
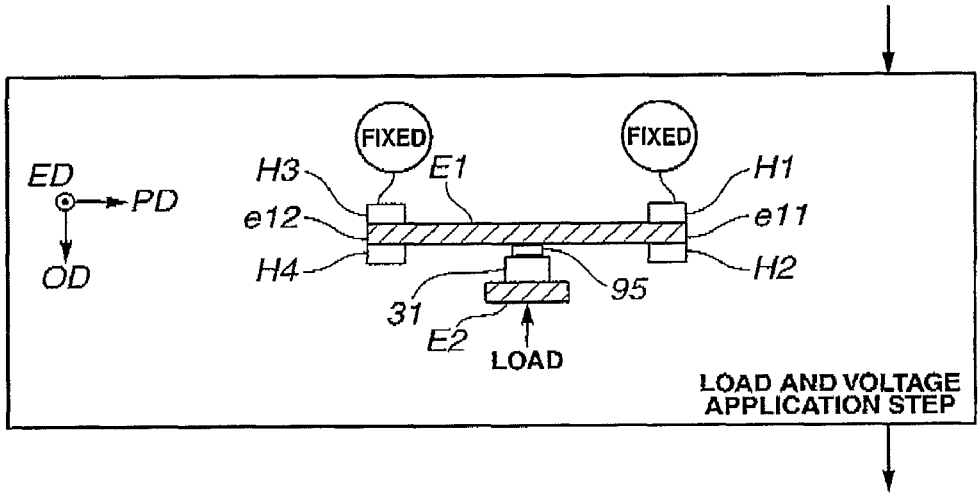
FIG. 9 is a schematic view depicting a manner for carrying out a load and voltage application in a fourth embodiment of the present invention.

FIG. 9 depicts a load and voltage application step that is carried out in a fourth embodiment of the method of the present invention. Since the step is similar to the above-mentioned load and voltage application step of FIG. 5C of the first embodiment, only things or manners different from those of the first embodiment will be described in the following.

That is, in this fourth embodiment, the holding members H1, H2, H3 and H4 only hold the first welding electrode E1. In other words, the holding members H1, H2, H3 and H4 have no function to bias the first welding electrode downward, that is, in the direction of the arrow "OD". However, during the welding, the second welding electrode E2 is biased upward, that is, in a direction opposite the direction of the arrow "OD". Other steps in this fourth embodiment are substantially same as those of the above-mentioned first embodiment. In this fourth embodiment, cost of equipment is reduced because the holding members H1, H2, H3 and H4 have no need of having a biasing means.

Referring back to FIG. 7B, if desired, the holding members H3 and H4 for the shorter first welding electrode E1*a* may have no function to bias the electrode E1*a* downward.

Fifth Embodiment

Figure 10:
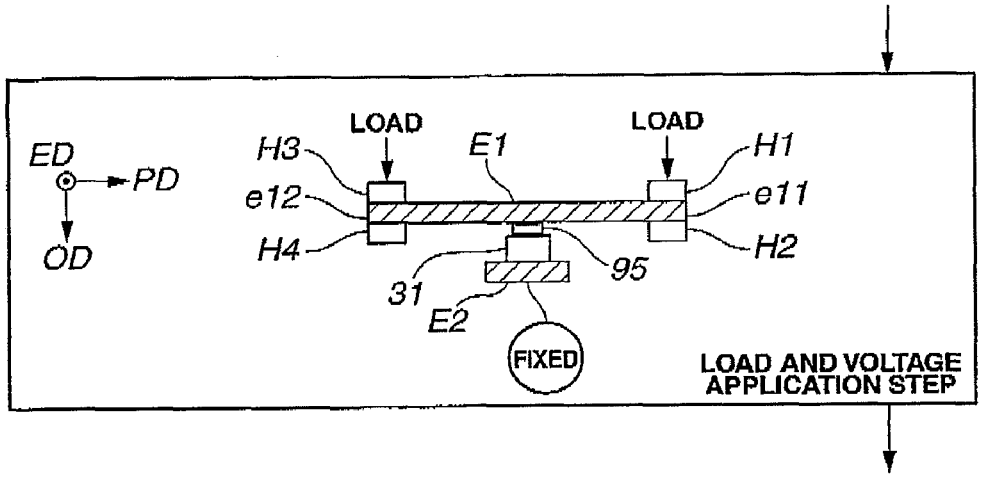
FIG. 10 is a schematic view depicting a manner for carrying out the load and voltage application in a fifth embodiment of the present invention.

FIG. 10 depicts a load and voltage application step that is carried out in a fifth embodiment of the method of the present invention. Since the step is similar to the above-mentioned load and voltage application step of FIG. 5C of the first embodiment, only things or manners different from those of the first embodiment will be described in the following.

That is, in this fifth embodiment, the second welding electrode E2 is not biased upward. In other words, the second welding electrode E2 is stably held by a holding member (not shown). However, during the welding, the first welding electrode E1 is biased downward, that is, in the direction of the arrow "OD". Other steps in this fifth embodiment are substantially the same as those of the first embodiment. Also, in this fifth embodiment, the cost of equipment is reduced.

Referring back to FIG. 7B, if desired, the second welding electrode E2 may not be biased upward.

Sixth Embodiment

Figure 11:
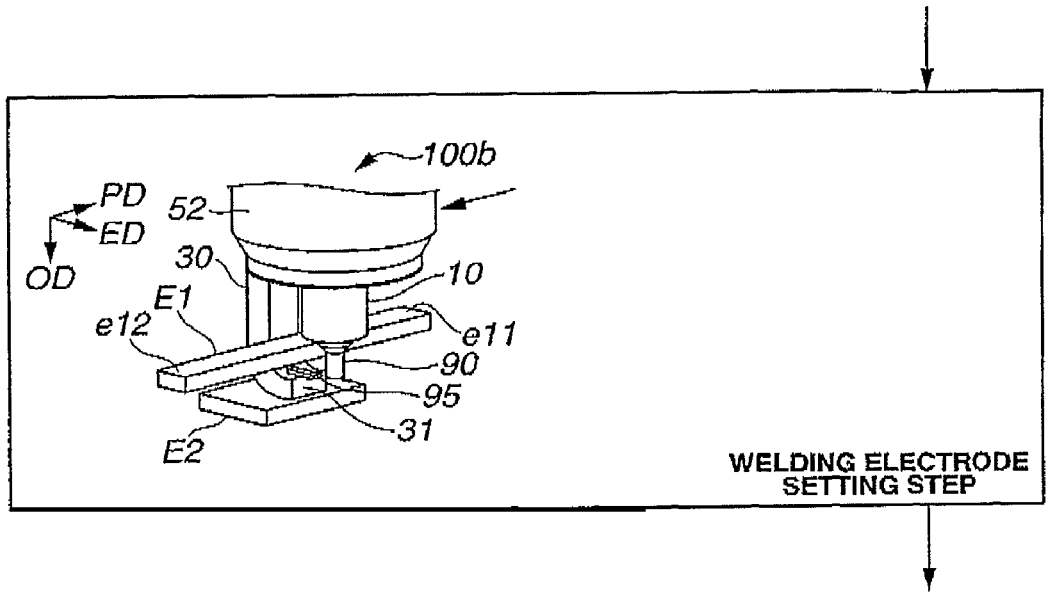
FIG. 11 is a schematic view depicting a manner for positioning a welding electrode in a sixth embodiment of the present invention.

FIG. 11 depicts a welding electrode setting step that is carried out in a sixth embodiment of the method of the present invention. Since the step is similar to the welding electrode setting step of FIG. 5B of the first embodiment, only things or manners different from those of the first embodiment will be described in the following.

That is, in this sixth embodiment, for setting the first welding electrode E1 to a desired position, the first welding electrode E1 is not moved. That is, in place of moving the first welding electrode E1, the semi-finished spark plug unit 100*b* is moved toward a desired position of the first welding electrode E1 where the second electrode tip 95 on the bent front portion 31 of the ground electrode 30 faces a lower surface of the middle portion of the first welding electrode E1. Other steps of this sixth embodiment are substantially same as those of the above-mentioned first embodiment.

Referring back to FIG. 7A, if desired, in place of the shorter first welding electrode E1*a*, the semi-finished spark plug unit 100*b* may move together with the second electrode tip 95 to a desired position of the shorter first welding electrode E1*a*.

Seventh Embodiment

Figure 12A:
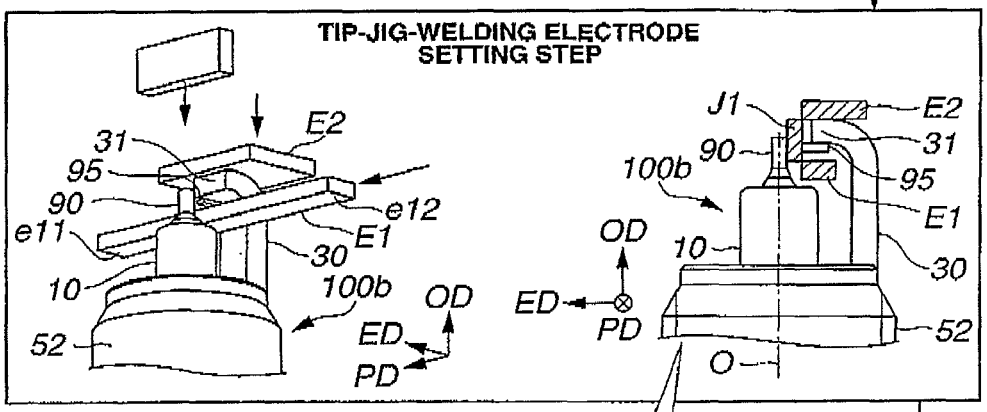
FIGS. 12A, 12A-a and 12B are schematic views depicting a manner for positioning an electrode tip, a spacer jig and welding electrodes and for carrying out a load and voltage application in a seventh embodiment of the present invention.
Figure 12A:
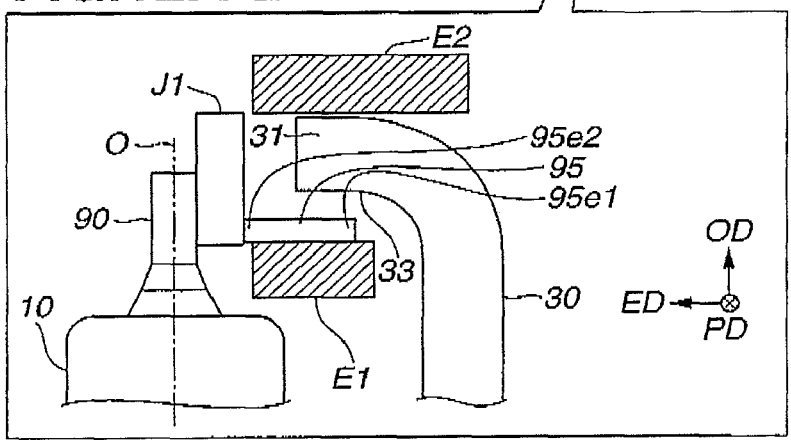
Figure 12B:
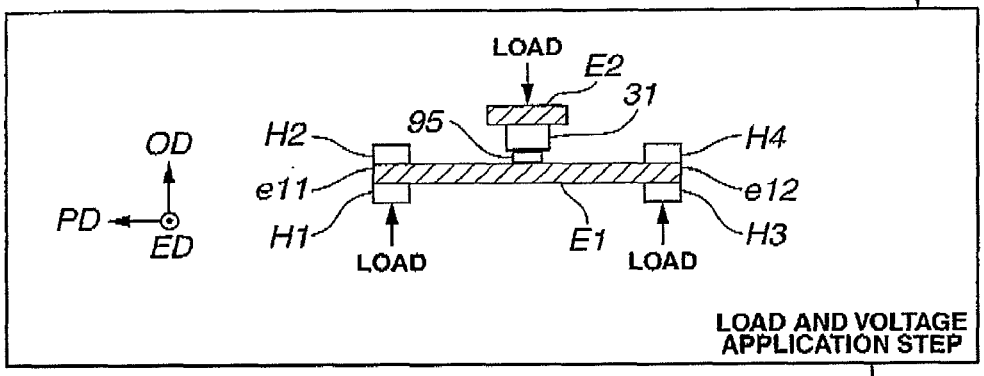

FIGS. 12A, 12A-a and 12B depict steps that are carried out in a seventh embodiment of the method of the present invention. FIG. 12A shows a tip-jig-welding electrode setting step and FIG. 12B shows a load and voltage application step.

Since this seventh embodiment is similar to the above-mentioned first embodiment, only things or manners different from those of the first embodiment will be described in the following.

As is shown in FIG. 12A, in the tip-jig-welding electrode setting step, the semi-finished spark plug unit 100*b* is set upside down in such a manner that the direction of the arrow "OD" faces upward and the second electrode tip 95 is put on the first welding electrode E1. The first welding electrode E1 is moved upward toward the bent front portion 31 of the ground electrode 30 carrying the electrode tip 95. That is, in the tip-jig-welding electrode setting step, the second electrode tip 95 is held by the first welding electrode E1.

As is seen from FIG. 12A-*a*, in the tip-jig-welding electrode setting step, the first welding electrode E1 contacts entirely the portion 95*e*1 of the second electrode tip 95 that is to be welded to the bent front portion 31 of the ground electrode 30 and contacts partially the other portion 95*e*2 of the second electrode tip 95 that is to be projected from the bent front portion 31 of the ground electrode 30. As is seen from this drawing, the second electrode tip 95 is easily supported by the first welding electrode E1, which means an easy positioning of the second electrode tip 95 relative to the bent front portion 31 of the ground electrode 30.

Then, the load and voltage application step as depicted by FIG. 12B is carried out. That is, the first welding electrode E1 is moved upward together with the second electrode tip 95 by the holding members H1, H2, H3 and H4 until the electrode tip 95 becomes contact with the bent front portion 31 of the ground electrode 30. Then, the second welding electrode E2 is moved downward until it contacts the bent front portion 31. Thus, the second electrode tip 95 and the bent front portion 31 become sandwiched between the first and second welding electrodes E1 and E2. Then, a certain high voltage is applied between the first and second welding electrodes E1 and E2 while biasing these electrodes Et and E2 toward each other. With this, the second electrode tip 95 is welded to a desired position of the bent front portion 31 of the ground electrode 30. Other steps in this seventh embodiment are substantially the same as those of the above-mentioned first embodiment.

If desired, in the seventh embodiment, the following modifications may be used. That is, one of the first and second welding electrodes E1 and E2 may not be biased during the welding like in the embodiment of FIG. 9 or FIG. 10. In place of moving the first and second welding electrodes E1 and E1 to desired positions, the semi-finished spark plug unit 100*b* may be moved to its desired position like in the sixth embodiment of FIG. 11. Furthermore, like in the second embodiment of FIG. 7B, a shorter first welding electrode E1*a* may be used.

Eighth Embodiment

Figure 13A:
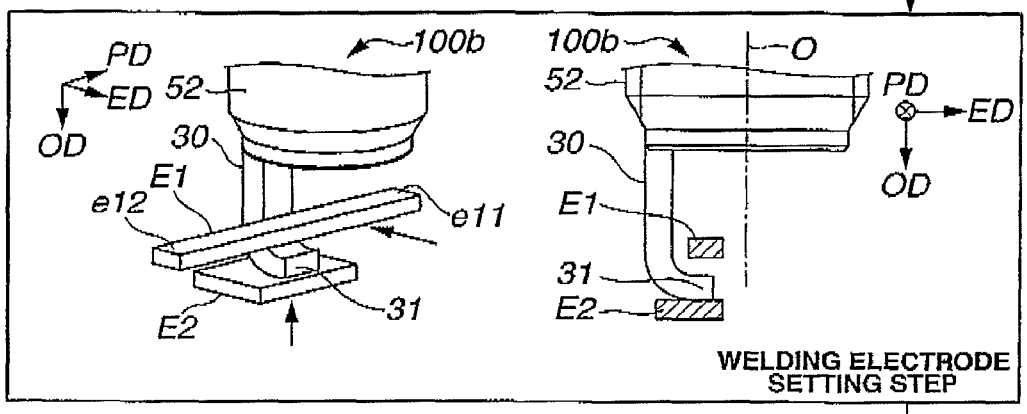
FIGS. 13A, 13B and 13C are schematic views depicting a manner for positioning the welding electrodes, the electrode tip and the spacer jig and for carrying out the load and voltage application in an eighth embodiment of the present invention.
Figure 13B:
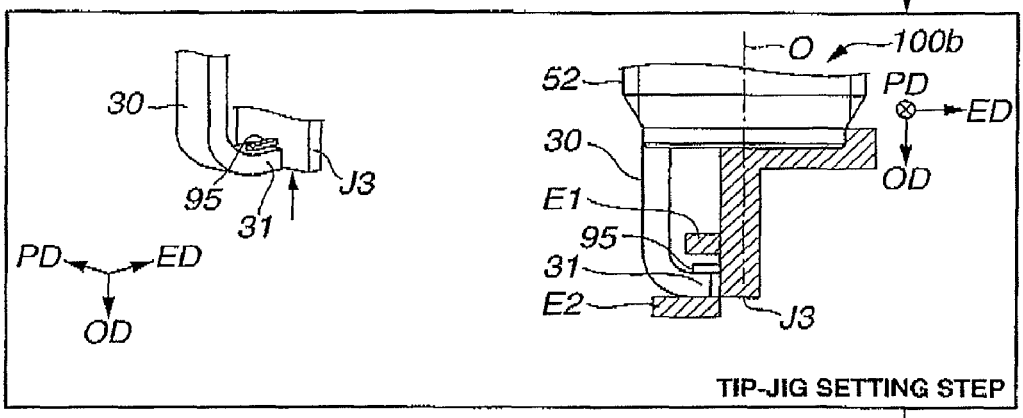
Figure 13C:
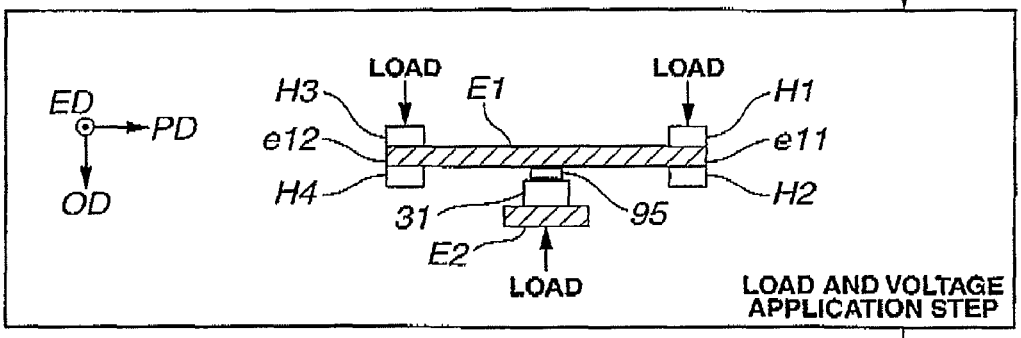

FIGS. 13A, 13B and 13C depict steps that are carried out in an eighth embodiment of the method of the present invention. FIG. 13A shows a welding electrode setting step, FIG. 13B shows a tip-jig setting step and FIG. 13C shows a load and voltage application step.

Since this eighth embodiment is similar to the above-mentioned first embodiment, only things or manners different from those of the first embodiment will be described in the following.

As is seen from FIGS. 13A and 13B, in this eighth embodiment, bending of the ground electrode 30 for forming the bent front portion 31 is made in advance, and before the ceramic insulator 10 is installed to the metal shell 50, the welding of the second electrode tip 95 to the bent front portion 31 of the ground electrode 30 is carried out. Thus, in this eighth embodiment, the ceramic insulator fixing step depicted by FIG. 4B is not made. More specifically, such ceramic insulator fixing step is carried out after the second electrode tip 95 is welded to the bent front portion 31. Furthermore, in this embodiment, the tip-jig setting step is carried out after the welding electrode setting step is made.

As is seen from FIG. 13A, in the welding electrode setting step, the first and second welding electrodes E1 and E2 are set like in the first embodiment. However, in this eighth embodiment, to take the desired position, the first welding electrode E1 is moved in a direction opposite to the direction of the arrow "ED".

Then, the tip-jig setting step as depicted by FIG. 13B is carried out. That is, the electrode tip 95 is put on the bent front portion 31 of the ground electrode 30 having a given front portion thereof projected from the leading end of the bent front portion 31, and a spacer jig J3 is set to the threaded portion 52 of the metal shell 50 having a given part thereof in contact with the front end of the electrode tip 95. With this, positioning of the second electrode tip 95 on the bent front portion 31 is assuredly made. Then, the first and second welding electrodes E1 and E2 are set in the above-mentioned manner.

Then, the load and voltage application step as depicted by FIG. 13C is carried out for welding the second electrode tip 95 to the bent front portion 31 of the ground electrode 30. That is, during the welding, the first and second welding electrodes E1 and E2 are kept biased toward each other having the electrode tip 95 and the bent front portion 31 sandwiched therebetween. When the welding is completed, the ceramic insulator fixing step like the step of FIG. 4B is carried out for finally producing the spark plug 100.

As is described hereinabove, in this eighth embodiment, the welding of the second electrode tip 95 to the ground electrode 30 is effected before the ceramic insulator 10 is installed to the metal shell 50. Accordingly, the first welding electrode E1 can move to the desired position between the bent front portion 31 of the ground electrode 30 and the threaded portion 52 of the metal shell 50 from various directions. In other words, the first welding electrode E1 can be easily moved to the desired position where the second electrode tip 95 is to be welded to a desired position of the bent front portion 31 of the ground electrode 30. It is to be noted that the method of welding the second electrode tip 95 to the ground electrode 30 before effecting the installation of the ceramic insulator 10 to the metal shell 50 is applicable to the afore-mentioned various embodiments.

Ninth Embodiment

Figures 14A, 14B:
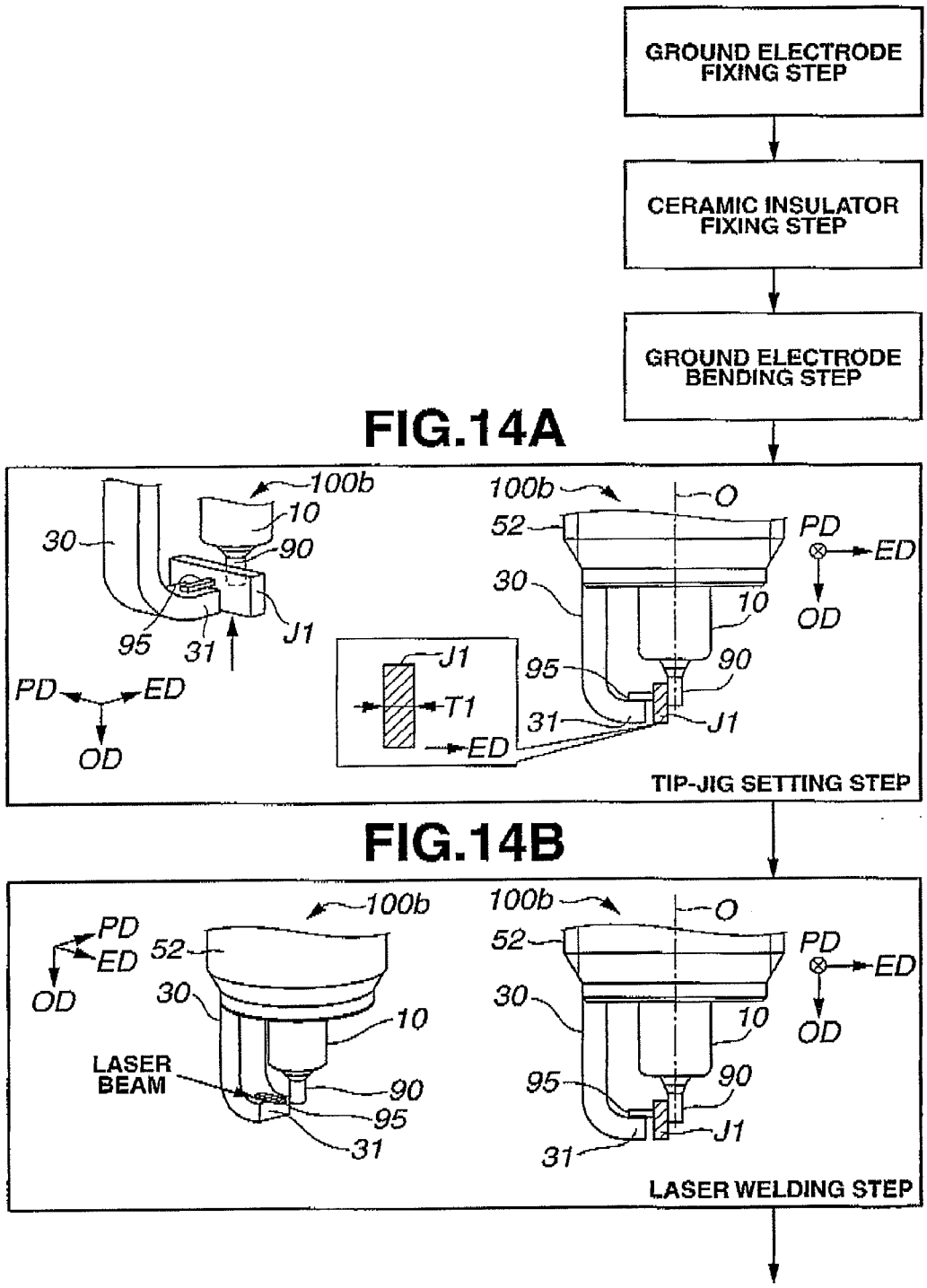
FIGS. 14A and 14B are schematic views depicting a manner for welding the electrode tip to the ground electrode by a laser welding, in a ninth embodiment of the present invention.

FIGS. 14A and 14B depict steps that are carried out in a ninth embodiment of the method of the present invention. In this ninth embodiment, a laser welding is used for welding the second electrode tip 95 to the ground electrode 30. It is to be noted that, in the above-mentioned first to eight embodiments, a resistance welding is used.

In this ninth embodiment, like in the above-mentioned first embodiment, the ground electrode fixing step, the ceramic insulator fixing step, the ground electrode bending step and the tip-jig setting step are carried out.

In the tip-jig setting step as depicted by FIG. 14A, the second electrode tip 95 is put on a desired part of the bent front portion 31 of the ground electrode 30, and the spacer jig J1 is intimately put between the two electrode tips 95 and 90. Then, the laser welding is carried out as is depicted by FIG. 14B.

In the perspective view of FIG. 14B that shows the laser welding step, the jig J1 is not shown for the purpose of clearly showing a positional relation between the second electrode tip 95 and the other electrode tip 90. In this laser welding step, a laser beam is applied to mutually contact portions between the second electrode tip 95 and the bent front portion 31 of the ground electrode 30. With this, the mutually contact portions of the two elements 95 and 31 are highly heated and thus welded together. With this, the second electrode tip 95 is assuredly welded to the bent front portion 31 of the ground electrode 30.

Figure 15:
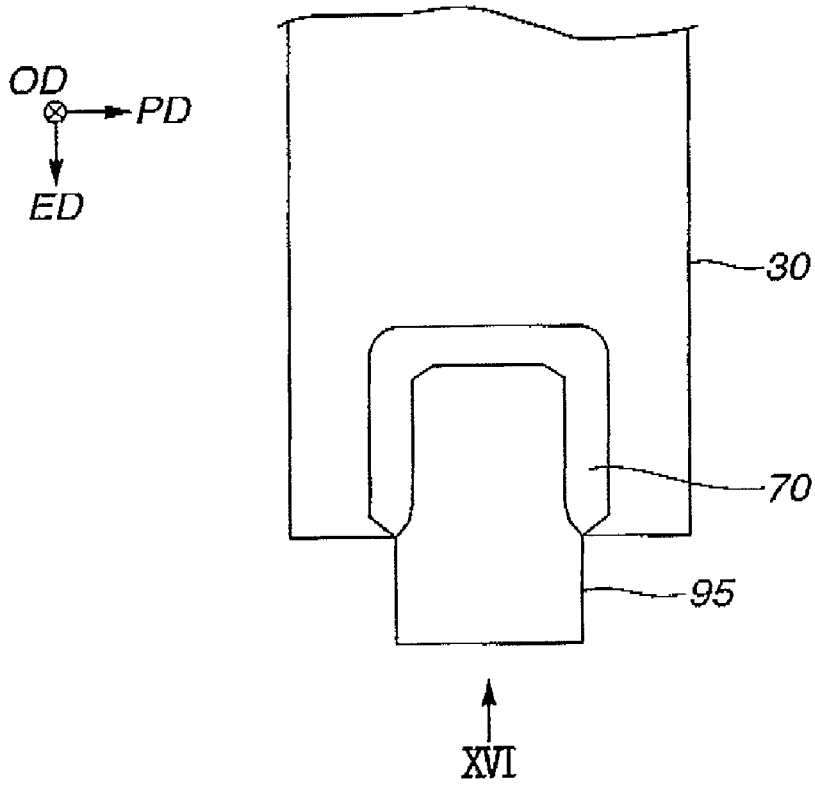
FIG. 15 is an enlarged view of the ground electrode to which the electrode tip is welded by the laser welding.
Figure 16:
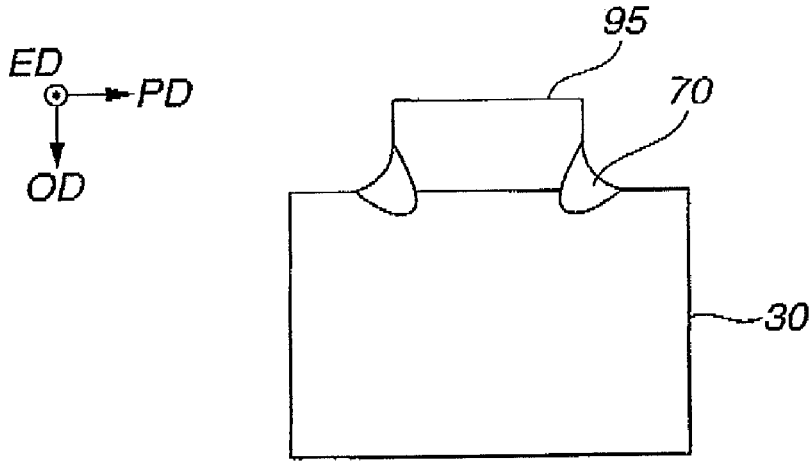
FIG. 16 is an enlarged view of the ground electrode of FIG. 15, but taken from a different direction.

FIGS. 15 and 16 show appearance of the portion where the second electrode tip 95 is welded to the ground electrode 30 (viz., bent front portion 31). FIG. 15 is a view taken from the above of the second electrode tip 95, and FIG. 16 is a view taken from the direction of the arrow "XVI" of FIG. 15. As is seen from these drawings, due to application of the laser welding, a fusion line 70 appears around peripheral edges of the mutually contact portions of the two elements 95 and 30. Because of usage of the spacer jig J1, the spark gap "G" is accurately provided between the two electrode tips 95 and 90.

In the following, various modifications of the above-mentioned embodiments will be described.

First Modification:

Besides the above-mentioned orders of assembling the spark plug 100, other orders are also usable. That is, the step of bending the ground electrode 30 for producing the bent front portion 31 may be made before the step of fixing the ground electrode 30 to the metal shell 50. Furthermore, before the step of welding of the second electrode tip 95 to the ground electrode 30, the adjustment of the spark gap "G" between the two electrode tips 95 and 90 may be made by using the spacer jig J1, J2 or J3. Furthermore, the ground electrode 30 may be so oriented that in the step of welding the second electrode tip 95 to the ground electrode 30, the axis of semi-finished spark plug unit 100*b* is perpendicular to the vertical direction.

Furthermore, the order for the step of putting the electrode tip 95 onto the ground electrode 30 and the step of setting the first welding electrode E1 may change. However, in either order, the first welding electrode E1 should be set at a position where it faces a given portion of the ground electrode 30 to which the second electrode tip 95 is to be welded. In this setting, the second electrode tip 95 can be pressed against the ground electrode 30 by using the first welding electrode E1. Furthermore, if desired, in place of the first welding electrode E1, a certain supporting member may be set at such a position as to face the given portion of the ground electrode 30 to which the electrode tip 95 is to be welded. In this case, the second electrode tip 95 is pressed against the ground electrode 30 by the supporting member. The portion of the second electrode tip 95 that is not supported by the supporting member may be supported by the first welding electrode.

If desired, by using a biasing member, the electrode tip 95 may be pressed against the spacer jig J1, J2 or J3. In this case, much accurate spark gap "G" can be provided between the two electrode tips 95 and 90.

Furthermore, the step of welding the electrode tip 95 to the ground electrode 30 may be made before the step of installing the center electrode 20 to the metal shell 50. Also in this case, the second electrode tip 95 welded to the bent front portion 31 of the ground electrode 30 should have a portion that projects from the leading end of the bent front portion 31 toward the first electrode tip 90.

Second Modification:

In each of the above-mentioned embodiments, the center electrode 20 has the first electrode tip 90 fixed thereof. However, if desired, such first electrode tip 90 may be removed. In place of such first electrode tip 90, the leading end portion 22 (see FIG. 2) of the center electrode 20 may extend forward by a degree corresponding to the length of the first electrode tip 90.

Third Modification:

In FIG. 6A that shows the welding step of the first embodiment, the first welding electrode E1 is shown to contact the front portion 95*e*2 of the second electrode tip 95 that is projected beyond the bent front portion 31 of the ground electrode 30. However, there may be no need of making such contact between the first welding electrode E1 and the projected front portion 95*e*2 of the second electrode tip 95. That is, it is essentially important to stably sandwich the bent front portion 31 of the ground electrode 30 and the electrode tip 95 between the first and second welding electrodes E1 and E2. If the first welding electrode E1 is set to contact both at least part of the rear portion 95*e*1 of the second electrode tip 95 and at least part of the front portion 95*e*2 of the electrode tip 95, a desirable slippage of the electrode tip 95 toward the spacer jig J1 is expected at the time when the resistance welding is carried out. This modification is applicable to the second, seventh and eighth embodiments.

Fourth Modification:

In the above-mentioned embodiments, for setting the first welding electrode E1 to the desired position, the same is moved in the direction opposite to the direction of the arrow "PD" and in the direction of the arrow "ED". However, besides such directions, the first welding electrode E1 may be moved in other directions. In general, the first welding electrode E1 can be moved from any direction perpendicular to the axial direction "OD" to the desired position to face the bent front portion 31 of the ground electrode 30. If the direction in which the first welding electrode E1 is moved toward the desired position is perpendicular to the direction (viz., the direction of the arrow "ED") in which the bent front portion 31 of the ground electrode 30 extends, undesired contact between the first welding electrode E1 and the center electrode 20 is suppressed.

Fifth Modification:

The spark plug 100 may have various forms. For example, the direction (viz., the direction of the arrow "ED") in which the bent front portion 31 of the ground electrode 30 extends may not be perpendicular to the axial direction "OD". Also in this form, the welding is carried out having the bent front portion 31 and the second electrode tip 95 sandwiched between the first welding electrode E1 or E1*a* and the second welding electrode E2. The ground electrode 30 may have a sectional form other than rectangle. That is, the ground electrode 30 may have a circular or other polygonal cross section. Also in such sectional forms, one end of the ground electrode 30 is fixed to the metal shell 50, and the other end portion of the ground electrode 30 is bent toward the center electrode 20 to have the bent front portion 31, and the second electrode tip 95 is welded to the bent front portion 31. As is understood from FIG. 2, once the spark plug 100 is finally produced, the ground electrode 30 can function as a guard member by which the two electrode tips 95 and 90 are protected from surrounding parts.

Sixth Modification:

In the third embodiment of FIGS. 8A, 8B and 8C, the first and second recesses R1 and R2 are formed on the opposed major surfaces of the spacer jig J2 for achieving the exact positional relation between the two electrode tips 95 and 90. Like this, the spacer jig J1 shown in FIGS. 5A and 5B may have such recesses for the same purpose. That is, due to provision of such recesses, not only undesired lateral displacement of the spacer jig J1 relative to the center electrode 20 but also undesired lateral displacement of the electrode tip 95 relative to the bent front portion 31 of the ground electrode 30 is suppressed. In the above, the spacer jigs J1, J2 and J3 are described to be made of a ceramic. Of course, such spacer jigs J1, J2 and J3 may be made of other insulating materials.

The entire contents of Japanese Patent Application 2008-165254 filed Jun. 25, 2008 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A method of producing a spark plug, comprising in steps:

(a) preparing a semi-finished spark plug unit, the unit comprising a center electrode that has a leading end portion, a cylindrical insulator that has an axial bore to install therein the center electrode except the leading end portion, a cylindrical metal shell that holds therein the cylindrical insulator and a ground electrode that has one end fixed to a leading end of the cylindrical metal shell;

(b) bending the ground electrode so that a bent front portion of the ground electrode projects toward the leading end portion of the center electrode;

(c) putting an electrode tip on a given part of the bent front portion of the ground electrode in such a manner that a front portion of the electrode tip projects from the bent front portion toward the leading end portion of the center electrode;

(d) welding the electrode tip to the given part of the bent front portion of the ground electrode;

(f) moving a spacer jig to a position between the electrode tip and the leading end portion of the center electrode; and (g) contacting the spacer jig to the leading end portion of the center electrode and contacting the electrode tip to the spacer jig, in which the spacer jig comprises:

a first stopper portion that contacts the electrode tip to restrain movement of the electrode tip in a direction perpendicular to both an axial direction of the semi-finished spark plug unit and a direction in which the electrode tip projects; and a second stopper portion that contacts the center electrode to restrain movement of the spacer jig in the direction perpendicular to both the axial direction of the semi-finished spark plug unit and the direction in which the electrode tip projects.

2. A method producing a spark plug as claimed in claim 1, further comprising (e) adjusting a distance between the electrode tip and the leading end portion of the center electrode, in which the step (e) is carried out by the step of (g).

3. A method as claimed in claim 2, in which the step (e) is carried out at substantially same time as the step (d).

4. A method as claimed in claim 1, further comprising, before the step (d):

(h) moving the electrode tip on an inside surface of the bent front portion of the ground electrode to the given part of the bent front portion; and (i) pressing the electrode tip against the spacer jig.

5. A method as claimed in claim 1, further comprising:

(v) setting the posture of the ground electrode in a manner to permit the step (d) while holding the semi-finished spark plug unit with the axial direction directed vertically downward.

6. A method as claimed in claim 1, further comprising:

(w) setting the posture of the ground electrode in a manner to permit the step (d) while holding the semi-finished spark plug unit with the axial direction directed vertically upward.

7. A method as claimed in claim 1, in which the step (d) is carried out by a laser welding.

8. A method of producing a spark plug, comprising in steps:

(a) preparing a semi-finished spark plug unit, the unit comprising a center electrode that has a leading end portion, a cylindrical insulator that has an axial bore to install therein the center electrode except the leading end portion, a cylindrical metal shell that holds therein the cylindrical insulator and a ground electrode that has one end fixed to a leading end of the cylindrical metal shell;

(b) bending the ground electrode so that a bent front portion of the ground electrode projects toward the leading end portion of the center electrode;

(c) putting an electrode tip on a given part of the bent front portion of the ground electrode in such a manner that a front portion of the electrode tip projects from the bent front portion toward the leading end portion of the center electrode; and (d) welding the electrode tip to the given part of the bent front portion of the ground electrode by means of a resistance welding, the step (d) including (j) contacting a first welding electrode to the electrode tip and contacting a second welding electrode to the bent front portion of the ground electrode thereby to sandwich both the electrode tip and the bent front portion between the first and second welding electrodes; (k) pressing the electrode tip and the bent front portion toward each other; and (l) applying a given voltage between the first and second welding electrodes thereby welding the electrode tip to the given part of the bent front portion of the ground electrode, in which the first welding electrode is in the shape of a bar, and in which the step (j) comprises:

(m) contacting a given portion of the first welding electrode to the electrode tip, the given portion being a portion other than both ends of the first welding electrode; and (n) holding the both ends of the first welding electrode.

9. A method as claimed in claim 8, in which the step (k) is carried out by contacting the first welding electrode to both an inside portion of the electrode tip that contacts the bent front portion of the ground electrode and an outside portion of the electrode tip that projects from the bent front portion.

10. A method as claimed in claim 8, in which the step (k) is carried out by applying a pressing force applied to the first welding electrode to the second welding electrode.

11. A method as claimed in claim 8, in which the step (k) is carried out by applying a pressing force applied to the second welding electrode to the first welding electrode.

12. A method as claimed in claim 8, in which the step (d) further comprises:

(q) carrying out a relative movement between the first welding electrode and the ground electrode to place the first welding electrode at a given position that faces the given part of the bent front portion of the ground electrode, the relative movement between the first welding electrode and the ground electrode including a movement of the first welding electrode in a given direction perpendicular to a longitudinal axis of the semi-finished spark plug unit.

13. A method as claimed in claim 12, in which the given direction is perpendicular to a direction in which the bent front portion of the ground electrode projects toward the leading end portion of the center electrode.

14. A method as claimed in claim 12, in which the given direction is the same as a direction in which the bent front portion of the ground electrode projects toward the leading end portion of the center electrode.

15. A method as claimed in claim 12, in which the step (q) comprises:

(r) fixing the ground electrode; and (s) moving the first welding electrode in the direction perpendicular to the axial direction of the semi-finished spark plug unit to the given position where the first welding electrode faces the ground electrode.

16. A method as claimed in claim 12, in which the step (q) comprises:

(t) fixing the first welding electrode; and (u) moving the ground electrode in such a manner that the first welding electrode makes a relative movement to the ground electrode in the direction perpendicular to the axial direction of the semi-finished spark plug unit and comes to the given position where the first welding electrode faces the ground electrode.

17. A method of producing a spark plug, comprising in steps:

(a) preparing a semi-finished spark plug unit, the unit comprising a center electrode that has a leading end portion, a cylindrical insulator that has an axial bore to install therein the center electrode except the leading end portion, a cylindrical metal shell that holds therein the cylindrical insulator and a ground electrode that has one end fixed to a leading end of the cylindrical metal shell;

(b) bending the ground electrode so that a bent front portion of the ground electrode projects toward the leading end portion of the center electrode;

(c) putting an electrode tip on a given part of the bent front portion of the ground electrode in such a manner that a front portion of the electrode tip projects from the bent front portion toward the leading end portion of the center electrode; and (d) welding the electrode tip to the given part of the bent front portion of the ground electrode by means of a resistance welding, the step (d) including (j) contacting a first welding electrode to the electrode tip and contacting a second welding electrode to the bent front portion of the ground electrode thereby to sandwich both the electrode tip and the bent front portion between the first and second welding electrodes; (k) pressing the electrode tip and the bent front portion toward each other; and (l) applying a given voltage between the first and second welding electrodes thereby welding the electrode tip to the given part of the bent front portion of the ground electrode, in which the first welding electrode is in the shape of a bar, and in which the step (j) comprises:

(o) contacting one end of the first welding electrode to the electrode tip; and (p) holding a front portion of the first welding electrode.

18. A method as claimed in claim 17, in which the step (d) further comprises:

(q) carrying out a relative movement between the first welding electrode and the ground electrode to place the first welding electrode at a given position that faces the given part of the bent front portion of the ground electrode, the relative movement between the first welding electrode and the ground electrode including a movement of the first welding electrode in a given direction perpendicular to a longitudinal axis of the semi-finished spark plug unit.

19. A method as claimed in claim 18, in which the given direction is perpendicular to a direction in which the bent front portion of the ground electrode projects toward the leading end portion of the center electrode.

20. A method as claimed in claim 18, in which the given direction is the same as a direction in which the bent front portion of the ground electrode projects toward the leading end portion of the center electrode.

21. A method as claimed in claim 18, in which the step (q) comprises:

(r) fixing the ground electrode; and (s) moving the first welding electrode in the direction perpendicular to the axial direction of the semi-finished spark plug unit to the given position where the first welding electrode faces the ground electrode.

22. A method as claimed in claim 18, in which the step (q) comprises:

(t) fixing the first welding electrode; and (u) moving the ground electrode in such a manner that the first welding electrode makes a relative movement to the ground electrode in the direction perpendicular to the axial direction of the semi-finished spark plug unit and comes to the given position where the first welding electrode faces the ground electrode.

* * * * *